US009343848B2

(12) United States Patent
Kodama et al.

(10) Patent No.: US 9,343,848 B2
(45) Date of Patent: May 17, 2016

(54) LEVER-FIT-TYPE CONNECTOR

(71) Applicant: Yazaki Corporation, Tokyo (JP)

(72) Inventors: Shinji Kodama, Makinohara (JP); Keita Mochizuki, Shimada (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/351,492

(22) PCT Filed: Oct. 31, 2012

(86) PCT No.: PCT/JP2012/078763

§ 371 (c)(1),
(2) Date: Apr. 11, 2014

(87) PCT Pub. No.: WO2013/065865

PCT Pub. Date: May 10, 2013

(65) Prior Publication Data

US 2014/0248788 A1 Sep. 4, 2014

(30) Foreign Application Priority Data

Oct. 31, 2011 (JP) ..... 2011-239432

(51) Int. Cl.
*H01R 13/629* (2006.01)
*H01R 13/639* (2006.01)
*H01R 12/88* (2011.01)

(52) U.S. Cl.
CPC .... *H01R 13/62933* (2013.01); *H01R 13/62938* (2013.01); *H01R 13/62955* (2013.01); *H01R 13/639* (2013.01); *H01R 12/88* (2013.01)

(58) Field of Classification Search
CPC ..... H01R 13/62955; H01R 13/62938; H01R 13/639; H01R 13/5219; H01R 13/641; H01R 4/4836; H01R 12/88; H01R 13/506; H01R 13/6275; H01R 2201/26; H01R 24/58; H01R 12/79; H01R 13/193; H01R 13/2442; H01R 13/502; H01R 13/5205; G01R 1/0466; G01R 1/0483; Y10T 29/49117; Y10T 29/49204; Y10T 29/49208; Y10T 403/7075; Y10T 4/20335
USPC ..... 439/310
See application file for complete search history.

(56) References Cited

U.S. PATENT DOCUMENTS 6,174,179 B1 * 1/2001 Okabe ..... H01R 13/62955 439/157
6,328,582 B1 12/2001 Fukamachi (Continued)

FOREIGN PATENT DOCUMENTS

CN 101383466 A 3/2009
CN 101615735 A 12/2009

(Continued)

OTHER PUBLICATIONS

International Search Report dated Jan. 16, 2013, issued by the International Searching Authority in counterpart International Application No. PCT/JP2012/078763.

(Continued)

*Primary Examiner* — Abdullah Riyami
*Assistant Examiner* — Justin Kratt
(74) *Attorney, Agent, or Firm* — Sughrue Mion, PLLC

(57) ABSTRACT

A lever-fit-type connector includes: a first connector; a lever provided on the first connector; and a second connector configured to be fitted with the first connector by an operation of the lever, wherein the lever includes a U-shaped elastic member including: a proximal end portion fixed to the lever; a distal end portion projecting in a vertical direction; a projecting portion projecting in a horizontal direction in the vicinity of the distal end portion; a U-shaped portion disposed between the proximal end portion and the distal end portion; and an engaging portion disposed between the distal end portion and the U-shaped portion, the U-shaped elastic member has a clearance between the proximal end portion and the distal end portion in the horizontal direction, and one of the first and second connectors includes an engaging portion operable to be engaged with the engaging portion of the U-shaped elastic member.

3 Claims, 21 Drawing Sheets

(56) References Cited

U.S. PATENT DOCUMENTS

| | | | | |
|---|---|---|---|---|
| 2009/0023316 | A1 | 1/2009 | Takahashi et al. | |
| 2009/0023317 | A1 | 1/2009 | Mizoguchi et al. | |
| 2009/0325411 | A1 | 12/2009 | Matsumura | |
| 2010/0210127 | A1 * | 8/2010 | Matsumura ..... | H01R 13/62966 439/157 |
| 2013/0059457 | A1 | 3/2013 | Hori | |

FOREIGN PATENT DOCUMENTS

| | | | |
|---|---|---|---|
| CN | 102160244 | A | 8/2011 |
| JP | 11-307172 | A | 11/1999 |
| JP | 2009-026580 | A | 2/2009 |
| JP | 2010-192156 | A | 9/2010 |

OTHER PUBLICATIONS

Written Opinion dated Jan. 16, 2013, issued by the International Searching Authority in counterpart International Application No. PCT/JP2012/078763.

Office Action dated Jun. 23, 2015 issued by the Japanese Patent Office in counterpart Japanese Patent Application No. 2011-239432.

Office Action dated Aug. 5, 2015 issued by The State Intellectual Property Office of the People's Republic of China in counterpart Chinese Application No. 201280053431.3.

Office Action dated Aug. 6, 2015 issued by Korean Intellectual Property Office in counterpart Korean Application No. 10-2014-7011785.

* cited by examiner

LEVER-FIT-TYPE CONNECTOR

TECHNICAL FIELD

The present invention relates to a lever-fit-type connector structured such that a first connector can be fitted with a second connector by rotating a lever mounted on the first connector.

BACKGROUND ART

There is a lever-fit-type connector in which, when fitting together male and female connectors respectively having multiple terminals, the fitting operation force is reduced by using a lever.

And, when the thus fitted or engaged male and female connectors are removed from each other, a lock lever provided on the lever is pushed to release the engagement (see PTL 1).

<Lever-Fit-Type Connector of Patent Reference 1>

FIGS. 22(A) and 22(B) are front views of a lever-fit-type connector disclosed in PTL 1. Specifically, FIG. 22(A) shows the fitted state of the male and female connectors before a lever is rotated, and FIG. 22(B) shows the fitted state of the male and female connectors after the rotation of the lever is completed.

In FIG. 22(A), a lever-fit-type connector 100 includes a connector 102 fittable with a partner connector 103 and a lever 101 rotatably supported on the connector 102, while the lever 101 has a cam groove 101C engageable with a cam pin 103C provided on the partner connector 103. By rotating the lever 101, the cam groove 101C and the cam pin 103C can be engaged with each other to generate cam action, thereby drawing the partner connector 103 toward the connector 102. The lever 101 includes a lever lock portion 111 (FIG. 22(B) which, as will be described below, when the rotation is completed, holds the lever 101 in a rotation prevented state.

<Lever Lock Portion 111 of Patent Reference 1>

In FIG. 22(B), the lever lock portion 111, which is used to hold the lever 101 in the rotation prevented state at the rotation completed time, includes the following structures respectively in the lever 101 and the connector 102 (or, the partner connector 103).

The structure on the lever 101 side includes a long elastic piece 111F flexibly deformable with a fixed end 111S formed in the end portion of the lever 101 as a fulcrum, an engaging portion 111K formed in such portion of the long elastic piece 111F as is distant from the fixed end 111S, and a releasing projection 111T formed between the fixed end 111S and engaging portion 111K.

On the other hand, the lever lock portion 111, on the connector 102 side, includes a lock receiving piece 102B extended upwardly from the lower end portion of the connector 102, and a lock receiving projection 102K provided on and projected from the connector 102 side distal end of the lock receiving piece 102B.

And, when the rotation of the lever 101 is completed, the engaging portion 111K and the lock receiving projection 102K can be engaged with each other.

<Releasing Operation of Lever Lock Portion 111>

Next, description will be given of the releasing operation of the lever lock portion 111 with reference to FIGS. 23(A), 23(B) and 23(C).

FIG. 23(A) is a section view of the lever lock portion 111 in a state where the lever 101 has completed its rotation. In the state of FIG. 23(A) where the lever 101 has completed its rotation, the engaging portion 111K existing near the distal end of the long elastic piece 111F formed in the lever 101 has climbed over and has been engaged with the lever lock receiving portion 102K on the connector 102 side due to the flexing operation of the long elastic piece 111F, whereby, even when any force to lift the lever 101 upwardly is applied thereto, the lever 101 is prevented from rotating in the reverse direction and thus this engaged state can be maintained.

To release the engagement of the lever 101, the releasing projection 111T formed in the long elastic piece 111F may be pushed in the arrow P1 direction of FIG. 23(B) with a forefinger, whereby the engaging portion 111K is disengaged from the lever lock receiving portion 102K due to the flexing operation of the long elastic piece 111F.

When the releasing projection 111T is pushed up in the arrow P2 direction of FIG. 23(C) while it is held with the forefinger, the engaging portion 111K is caused to climb over the lever lock receiving portion 102K of the connector 102 and move upwardly thereof, whereby the engagement is released.

<Problems Found in Lever Lock Portion 111>

The lever lock portion 111 can secure the necessary flexing amount of the elastic piece without increasing the size of the lever and can provide an enhanced lock feeling effect. However, it has been found that it has two following problems.

<First Problem>

Since the releasing projection 111T (point of force) is formed between the fixed end 111S (fulcrum) and engaging portion 111K (point of action), the distance from the fixed end 111S (fulcrum) to the releasing projection 111T (force point) is short. Thus, to release the engagement of the engaging portion 111K (point of action), the releasing projection 111T must be pushed with large force.

<Second Problem>

Recently, multiple lever-fit-type connectors 100 have been arranged adjacently to each other. However, when other connector is arranged in an area adjoining the lever, the area cannot provide a lateral-direction space allowing the pressing of the releasing projection 111T, thereby raising a possibility that the engagement cannot be released.

Also, in order to avoid this, a space necessary for pushing the releasing projection 111T must be provided previously, which impairs the freedom of design.

CITATION LIST

Patent Literature (PTL 1) JP-A-2009-26580

SUMMARY OF INVENTION

Technical Problem

The invention aims at solving the above-mentioned two problems. Thus, it is an object of the invention to provide a lever fit-type connector including a lever lock portion which (1) does not require large pushing force to release the engagement of the engaging portion, and (2) can arrange multiple lever-fit-type connectors 100 adjacently and thus cannot impair the freedom of design.

Solution to Problem

According to an aspect of the invention, there is provided a lever-fit-type connector comprising: a first connector; a lever provided on the first connector; and a second connector configured to be fitted with the first connector by an operation of the lever, wherein the lever includes a U-shaped elastic member including: a proximal end portion fixed to the lever; a distal end portion projecting in a vertical direction; a projecting portion projecting in a horizontal direction in the vicinity of the distal end portion; a U-shaped portion disposed between the proximal end portion and the distal end portion; and an engaging portion disposed between the distal end portion and the U-shaped portion, the U-shaped elastic member has a clearance between the proximal end portion and the distal end portion in the horizontal direction, and one of the first connector and the second connector includes an engaging portion operable to be engaged with the engaging portion of the U-shaped elastic member of the lever.

The clearance may be exposed upwardly from the lever.

The first connector may include a boss portion on a side surface, the lever may include: a central portion rotatably mounted on the boss portion of the first connector; and a fulcrum projection provided on one end, the second connector may include: a fit space; and a groove formed in an inner wall of the fit space. In a state that the fulcrum projection of the lever is positioned in the groove of the second connector, by pushing the other end of the lever toward the second connector to rotate lever to cause the fulcrum projection of the lever to act as a fulcrum and to cause the central portion of the first connector to act as a point of action, the first connector may be pushed into the fit space and be fitted with the second connector.

Advantageous Effects of Invention

According to an aspect of invention, the lever lock portion is a U-shaped long elastic piece extending from the fixed end of the end portion of the lever and making a U-turn to return upwardly and includes the releasing projection formed near the distal end thereof. Therefore, when releasing the engagement of the engaging portion, large pressing force is not necessary.

Further, in the case that multiple lever-fit-type connectors 100 are arranged adjacently, a forefinger can be inserted from above into a clearance formed in the horizontal direction between the fixed end and distal end sides of the U-shaped long elastic piece, the distal end of the U-shaped long elastic piece can be moved toward the fixed end by the forefinger while depressing the distal end thereof to thereby release the engagement between the engaging portion and lock receiving projection, and, in this state, the two side surfaces of the operation portion of the lever can be sandwiched and lifted upwardly by a thumb and the forefinger, thereby being able to release the lever lock.

Thus, when a space for pushing the releasing projection horizontally exists, the lever lock can be released by pushing the releasing projection horizontally, and when such space does not exists, instead of pushing horizontally, by inserting a finger from above, the lever lock can be released. That is, the lever lock can be released from two directions. On the other hand, the lever-fit-type connector disclosed in PTL 1 cannot realize this.

BRIEF DESCRIPTION OF DRAWINGS

FIG. 4(A) shows a pushing direction in the lock releasing operation, FIG. 4(B) shows a lever pushing-up operation, and FIG. 4(C) shows the procedure of the first releasing method shown in FIG. 4(A), in which (1) shows a state just before start of the releasing operation, (2) shows a state just after start of the releasing operation, and (3) shows a lever pushing-up state.

FIG. 5(A) shows a pushing direction in the lock releasing operation, FIG. 5(B) shows a lever pulling-up operation, and FIG. 5(C) shows the procedure of the second releasing method shown in FIG. 5(A), in which (1) shows a state just before start of the releasing operation, (2) shows a state just after start of the releasing operation, and (3) shows a lever pulling-up state.

FIGS. 22(A) and 22(B) are front views of a lever-fit-type connector disclosed in PTL 1, in which FIG. 22(A) shows a state before the connectors thereof are fitted with each other and FIG. 22(B) shows a state where the fit is completed.

DESCRIPTION OF EMBODIMENTS

Figure 1:
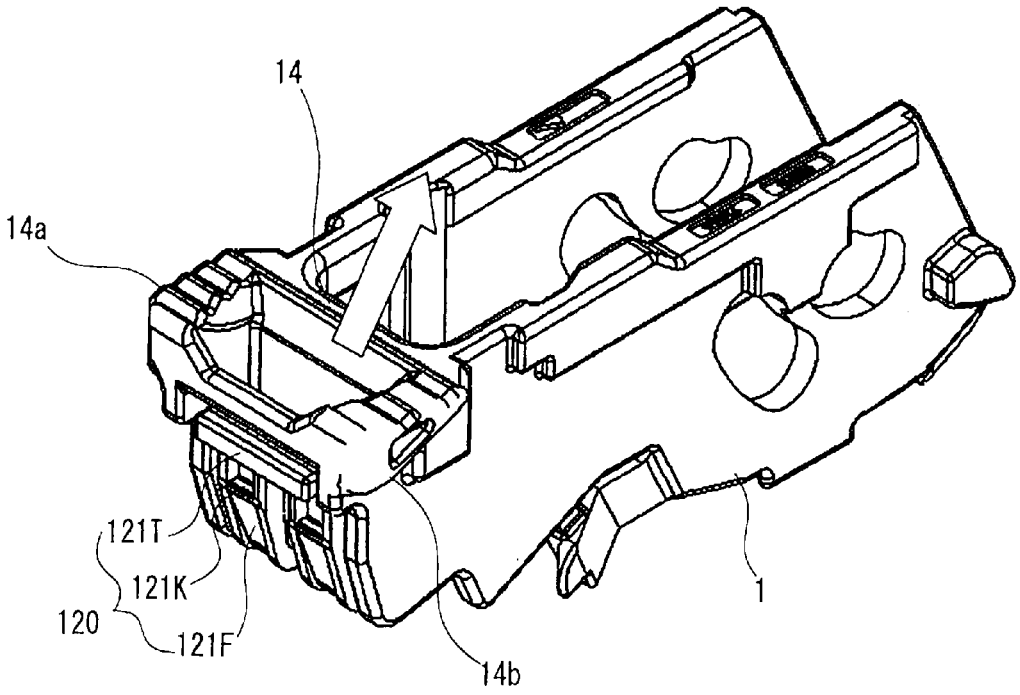
FIG. 1 is a perspective view of a lever including a lever lock portion according to the invention.

Before describing a preferred lever lock portion according to the invention, description will be given briefly of the structure of a lever-fit-type connector to which the lever lock portion of the invention is applied.

<Structure of Lever-Fit-Type Connector According to the Invention>

Description will be given below of a lever-fit-type connector according to the invention with reference to FIGS. 7 to 21(*b*).

A lever-fit-type connector 10 shown in FIG. 7 includes a male connector (which is hereinafter called a first connector) 2, a lever 1 rotatably mounted on the connector housing 20 of the first connector 2, and a female connector (which is hereinafter called a second connector) 3 containing a connector housing 30 having a fit space 39 into which the first connector 2 can be fitted, in which, by rotating the lever 1, the first connector 2 is pushed into the deep side of the fit space 39 along a fitting direction K and is thereby fitted with the second connector 3.

<First Connector 2>

Figure 7:
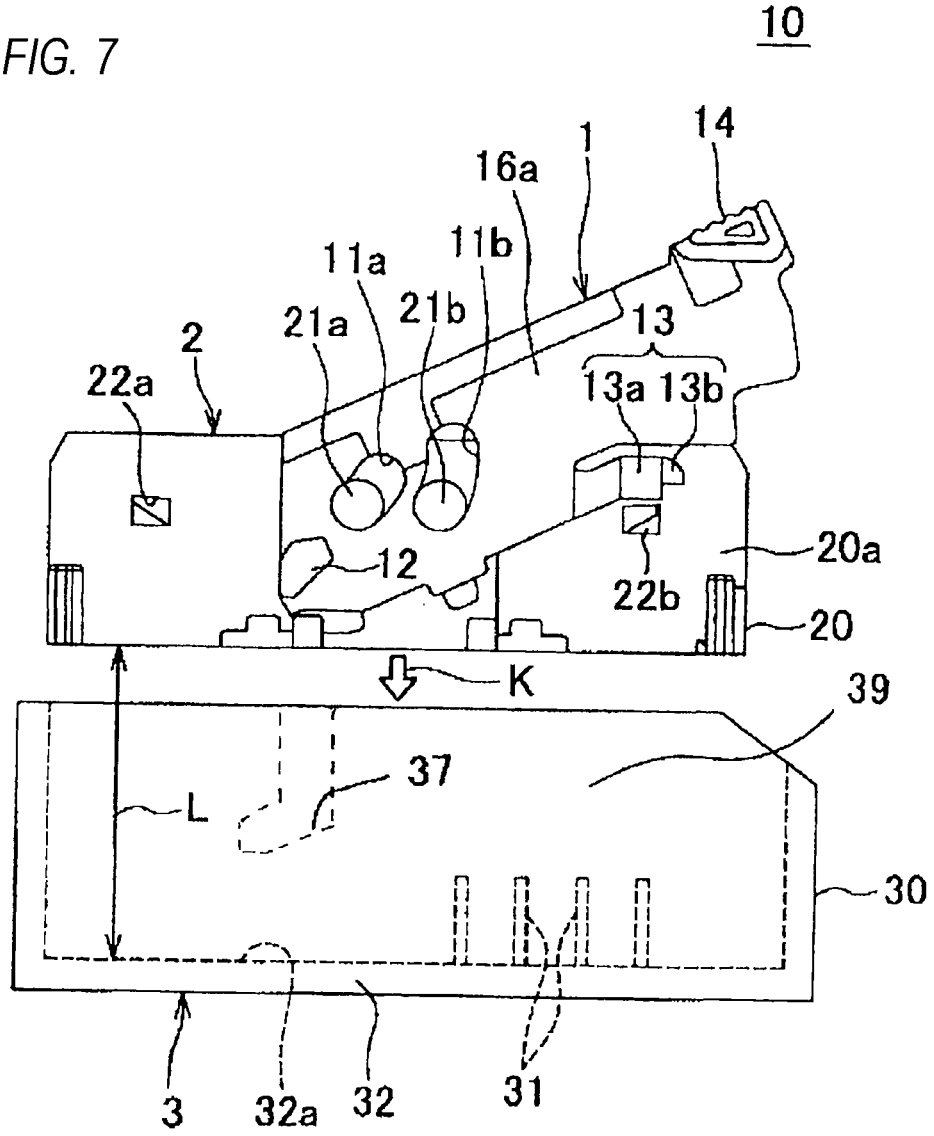
FIG. 7 is a front view of the lever-fit-type connector according to the invention, showing a state before the first and second connectors are fitted with each other.
Figure 8:
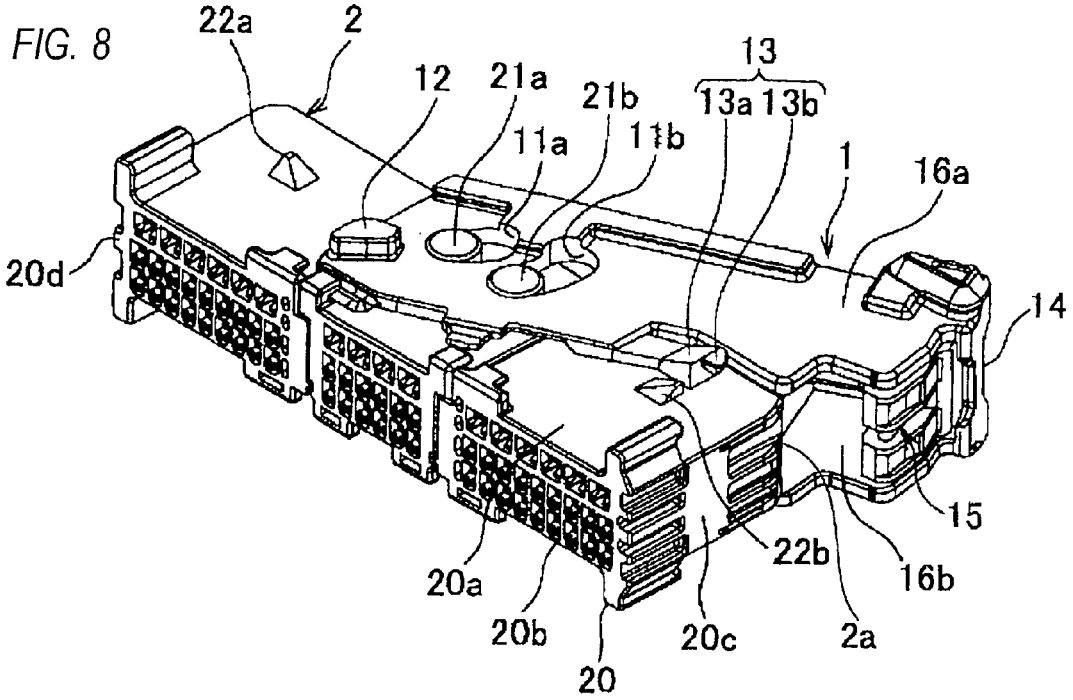
FIG. 8 is a perspective view of the first connector with a lever of the lever-fit-type connector shown in FIG. 7.
Figure 9:
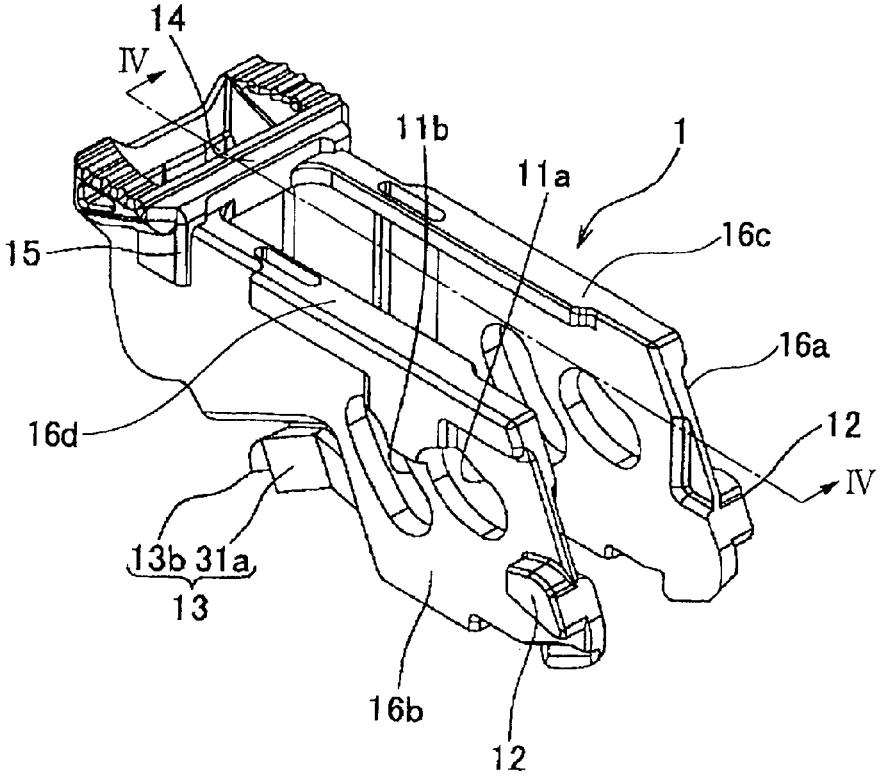
FIG. 9 is a perspective view of the lever of the lever-fit-type connector shown in FIGS. 1 and 7, when viewed from the fulcrum projection side thereof.
Figure 18A:
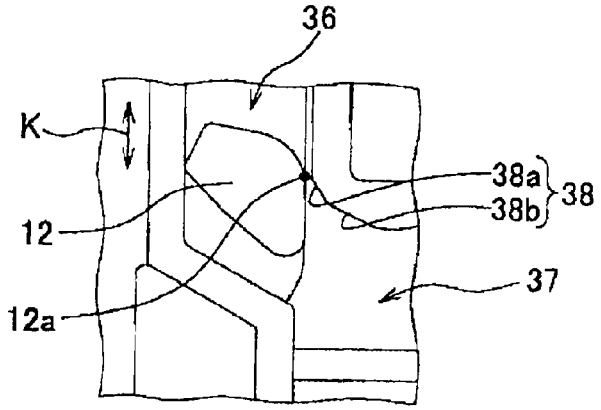
FIG. 18(*a*) is an enlarged view of the fulcrum projection of the lever-fit-type connector shown in FIGS. 13(*a*), 13(*b*) and 13(*c*), FIG. 18(*b*) is a section view of the lever-fit-type connector shown in FIG. 18(*a*), showing the position relationship of the terminals thereof, and FIG. 18(*c*) is an explanatory view of the position of the fulcrum projection when the rotation prevented state of the lever of the lever-fit-type connector shown in FIG. 18(*a*) is released.
Figure 18B:
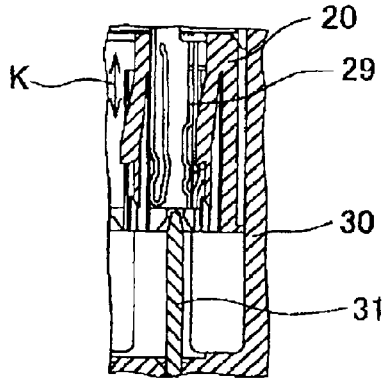
Figure 18C:
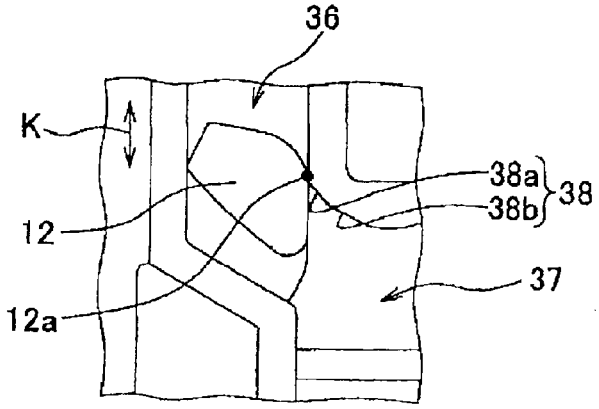

The first connector 2, as shown in FIGS. 7 and 8, includes a rectangular connector housing 20 formed of insulating synthetic resin and a terminal (female terminal) 29 (FIG. 18(*b*)) stored in the connector housing 20.

<Connector Housing 20>

The connector housing 20 includes mutually opposed side surfaces 20*a*, 20*b* and connecting surfaces 20*c*, 20*d* connecting together the end portions of the side surfaces 20*a*, 20*b*. In the longitudinal-direction central portions of the side surfaces 20*a*, 20*b*, there are formed cylindrical-shaped boss portions 21*a*, 21*b* spaced from each other. The longitudinal direction is a direction perpendicular to the fitting direction K shown in FIG. 7. The side surfaces 20*a*, 20*b* respectively include, on their longitudinal-direction ends, trapezoidal-shaped temporarily holding projection portions 22*a*, 22*b* respectively projected from the surfaces of the side surfaces 20*a*, 20*b*.

<Lever 1>

The lever 1 is made of insulating synthetic resin and, as shown in FIGS. 5(A) to 9, includes a pair of side plates 16*a*, 16*b* disposed parallel to each other with their one-side end portions spaced and separated from each other, and an operation portion 14 connecting the other end portions of the paired side plates 16*a*, 16*b*.

<Operation Portion 14>

The operation portion 14 is a portion to which a load is applied when rotating the lever 1, that is, a point of force of the lever 1. The operation portion 14 includes a lock arm 15 which, in a state where the first connector 2 is fitted with the second connector 3, can be engaged with the connector housing 30 of the second connector 3. The lock arm 15, when engaged with the connector housing 30, prevents the first connector 2 from moving in a direction to part away from the second connector 3 when unexpected external force is applied to the lever 1. This will be discussed later specifically.

<Side Plates 16*a*, 16*b*>

The paired side plates 16*a*, 16*b* respectively include fulcrum projections 12 provided on their one-end portions. The fulcrum projections 12, when positioned within fulcrum projection storing grooves 37 formed in the connector housing 30 of the second connector 3, are caught in the connector housing 30 to provide the fulcrums of the lever 1. Also, in the portions that exist nearer to the other end portions than the fulcrum projections 12, there are formed a pair of boss portion storing holes 11*a*, 11*b* respectively for positioning the boss portions 21*a*, 21*b*. The boss portion storing holes 11*a*, 11*b* provide points of action of the lever 1 with respect to the connector housing 20.

Also, the paired side plates 16*a*, 16*b* include temporarily holding contact pieces 13 provided in the lower ends of the other end portions thereof.

<Temporarily Holding Contact Piece 13>

The temporarily holding contact pieces 13, when positioned in such portions as more distant from the second connector 3 than any one of the temporarily holding projection portions 22*a*, 22*b* in the initial stage of fitting of the connectors 2, 3, prevent the lever 1 from rotating toward the second connector 3. The temporarily holding contact pieces 13 respectively include contact projection portions 13*a* having end faces contactable with the temporarily holding projection portions 22*a*, 22*b*, and flexible pieces 13*b* connected to the contact projection portions 13*a* and extending toward the other end portions of the side plates 16*a*, 16*b*. Each flexible piece 13*b* is formed to have a smaller thickness than the contact projection portion 13*a* and is easy to flex. Also, the flexible pieces 13*b* extend outwardly along a direction where the paired side plates 16*a*, 16*b* are opposed.

<Second Connector 3>

Figure 10:
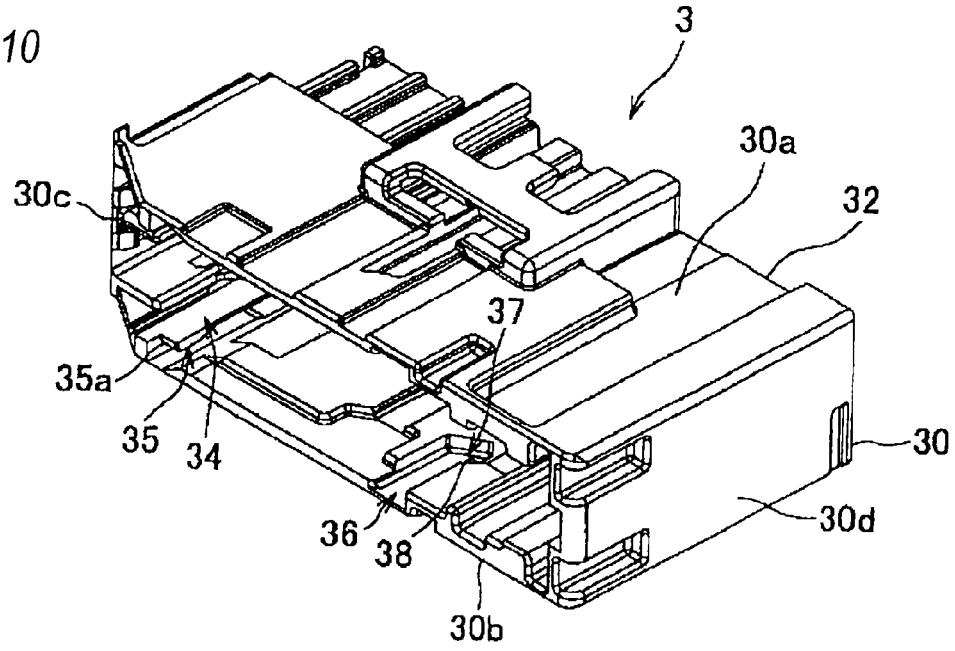
FIG. 10 is a perspective view of the second connector of the lever-fit-type connector shown in FIG. 7.

The second connector 3, as shown in FIGS. 7 and 10, is made of insulating synthetic resin and includes a female connector housing 30 having a fit space 39 and terminals (male terminals) 31 stored in the connector housing 30. The male terminals 31 can be fitted with the terminals (female terminals) 29 of the first connector 2.

<Connector Housing 30>

The connector housing 30 includes mutually opposed side surfaces 30*a*, 30*b*, connecting surfaces 30*c*, 30*d* connecting together the end portions of the side surfaces 30*a*, 30*b*, and a bottom surface 32 for supporting the terminals 31 provided on the opposite side to the opening of the fit space 39. The side surfaces 30*a*, 30*b*, connecting surfaces 30*c*, 30*d* and bottom surface 32 define the fit space 39. The side surfaces 30*a*, 30*b* respectively include, in their inner surfaces (inner walls), fulcrum projection guide grooves 36 extending from the upper ends (which mean the ends distant from the bottom surface 32) of the inner surfaces toward the deep side of the fit space 39 along the fitting direction, fulcrum projection storing grooves 37 connected to the end portions distant from the above-mentioned upper ends of the fulcrum projection guide grooves 36 and extending in a direction to cross the fulcrum projection guide grooves 36, and plate-shaped releasing plate portions 35.

<Fulcrum Projection Storing Groove 37>

The fulcrum projection storing grooves 37, when the lever 1 is rotated, position the fulcrum projections 12 and control them to operate as the fulcrum of the lever 1. The fulcrum projection storing grooves 37, as shown in FIGS. 18(*a*) to 21(*b*), include edge walls 38 contactable with the outer edge portions of the fulcrum projections 12.

<Edge Wall 38>

The edge wall 38 includes a first taper wall 38*b* and a second taper wall 38*a* for guiding the fulcrum projection 12 to the first taper wall 38*b*. The first taper wall 38*b* inclines in such a manner that it reduces the width of the fulcrum projection storing groove 37 as it parts away from the fulcrum projection guide groove 36. The second taper wall 38*a* inclines in such a manner that it increases the width of the fulcrum projection storing groove 37 as it parts away from the fulcrum projection guide groove 36. Also, the fulcrum projection guide groove 36 guides the fulcrum projection 12 until it is positioned in the fulcrum projection storing groove 37.

Due to provision of such second taper wall 38*a*, even when the rotation prevented state of the lever 1 is released early, the second taper wall 38*a* can pick up and guide the fulcrum projection 12 to the first taper wall 38*b*. Thus, at the time when the rotation prevented state of the lever 1 is released, the fulcrum projection 12 can be positively positioned within the fulcrum projection storing groove 37.

<Plate-Shaped Releasing Plate Portion 35>

The releasing plate portion 35, as the first connector 2 is made to approach the second connector 3, moves into the flexible piece 13*b* of the temporarily holding contact piece 13 and flexes the flexible piece 13*b* outwardly along the mutually opposing direction of the paired side plates 16*a*, 16*b*, thereby causing the contact projection portion 13*a* to climb over toward the second connector 3 side of the temporarily holding projection portions 22*a*, 22*b*. The releasing plate portion 35, as shown in FIG. 10, is formed integrally with a relative wall 34 disposed opposed to the inner surfaces of the side surfaces 30*a*, 30*b*.

Figure 11:
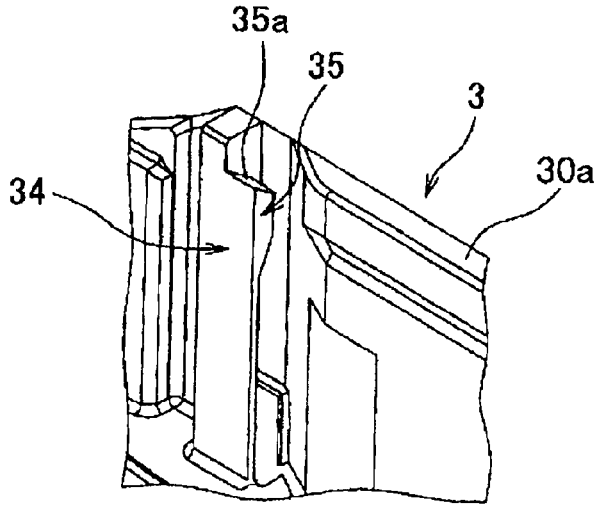
FIG. 11 is a perspective view of the second connector shown in FIG. 10, showing the housing interiors thereof.

Also, as shown in FIG. 11, the releasing plate portion 35, includes, in its upper end, a taper portion 35*a* formed such that its thickness gradually increases as it goes toward the deep side of the fit space 39 (FIG. 7) along the fitting direction.

Here, holding force (temporarily holding force) to be applied from the contact projection portions 13*a* to the temporarily holding projection portions 22*a*, 22*b* in order to hold the lever 1 in the rotation prevented state, that is, the degree of the difficulty of removal of the contact projection portions 13*a* from the temporarily holding projection portions 22*a*, 22*b* depends on the amount of application of the flexible piece 13*b* to the taper portion 35*a*; and, at the time when the flexible piece 13*b* has completely climbed over the taper portion 35*a*, the holding force becomes zero. That is, the rotation prevented state of the lever 1 is released.

<Operation to be Executed Until Terminals 29, 31 in Lever-Fit-Type Connector are Fitted>

Now, description will be given below of operations to be executed until the terminals 29, 31 of the lever-fit-type connector are fitted with each other.

<Step 1>

Figure 12A:
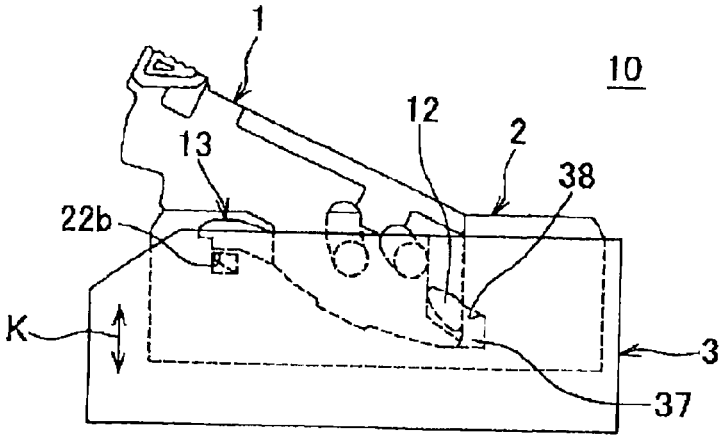
FIG. 12(*a*) is a plan view of the lever-fit-type connector shown in FIG. 7, showing an initial state of the fit thereof, FIG. 12(*b*) is an enlarged view of a temporarily holding contact piece of the lever-fit-type connector shown in FIG. 12(*a*), and FIG. 12(*c*) is a section view taken along the A-A line shown in FIG. 12(*b*).
Figure 12B:
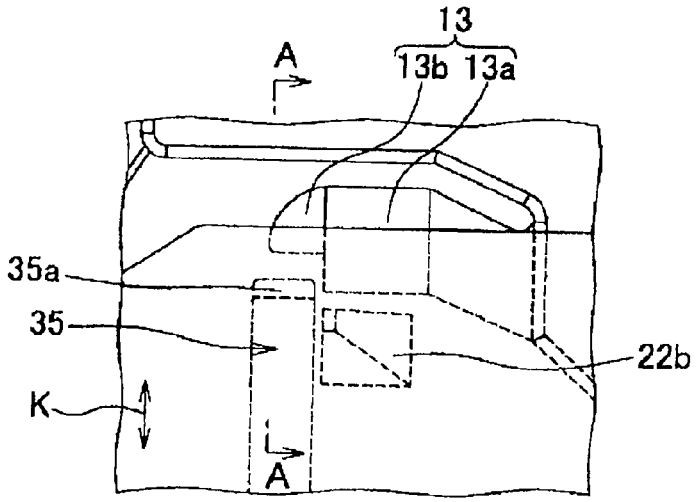
Figure 12C:
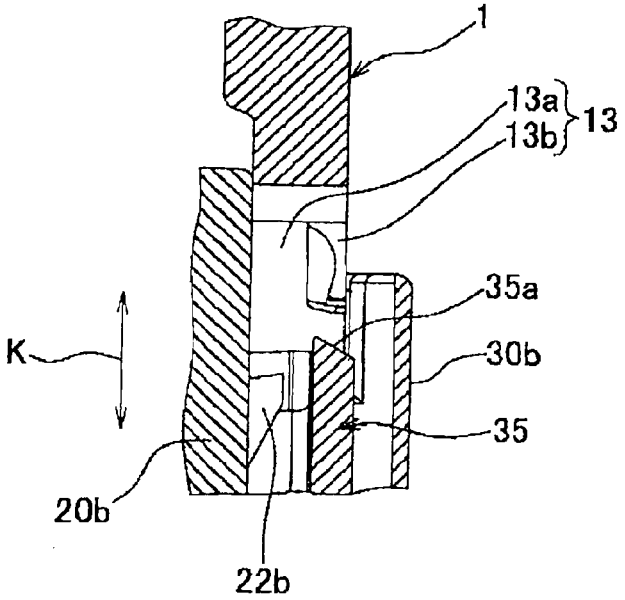

In the lever-fit-type connector 10, the lever 1 is mounted on the first connector 2 and, with the lever 1 held in the rotation prevented state (see FIGS. 12(*a*) to 12(*c*)), the first connector 2 is inserted into the fit space 39 of the connector housing 30 of the second connector 3 (FIG. 12(*a*)).

<Step 2>

Figure 13A:
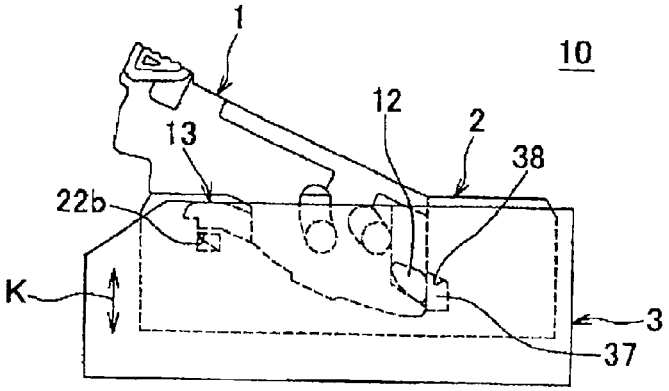
FIG. 13(*a*) is a plan view of the lever-fit-type connector shown in FIGS. 12(*a*), 12(*b*) and 12(C), showing a state where the first connector is inserted into the deeper side of the second connector, FIG. 13(*b*) is an enlarged view of the temporarily holding contact piece of the lever-fit-type connector shown in FIG. 13(*a*), and FIG. 13(*c*) is a section view taken along the B-B line shown in FIG. 13(*b*).
Figure 13B:
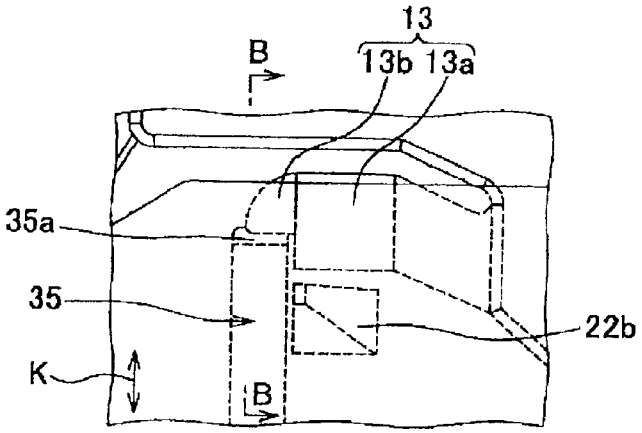
Figure 13C:
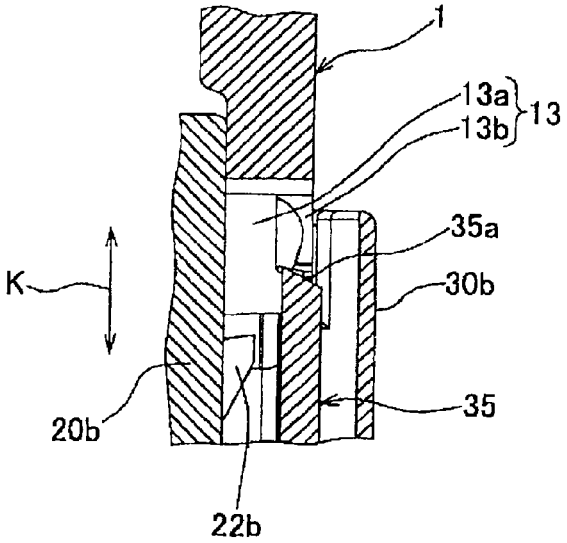

As shown in FIG. 13(*a*), when the first connector 2 is inserted into the connector housing 30 until it can be inserted due to its own weight, as shown in FIGS. 13(*b*) and 13(*c*), the upper end of the taper portion 35*a* of the releasing plate portion 35 advances into the inside of the flexible piece 13*b*. In this state, such outer edge portion 12*a* of the fulcrum projection 12 as exists nearest to the one end side of the lever 1, as shown in FIG. 18(*a*), is situated above the second taper wall 38*a* in the fitting direction K. That is, the fulcrum projection 12 is situated within the fulcrum projection guide groove 36. Also, as shown in FIG. 18(*b*), the terminals 29, 31 have not yet been connected to each other. In this state, when the rotation prevented state of the lever 1 is released and thus the lever 1 is rotated, as shown in FIG. 18(*c*), the fulcrum projection 12 is not pulled into the fulcrum projection storing groove 37 but the lever 1 rotates idly.

<Step 3>

Figure 14A:
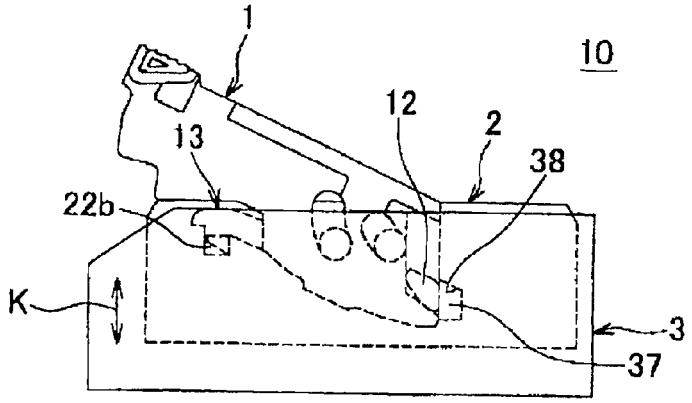
FIG. 14(*a*) is a plan view of the lever-fit-type connector shown in FIGS. 13(*a*), 13(*b*) and 13(*c*), showing a state where the first connector is pushed toward the second connector, FIG. 14(*b*) is an enlarged view of the temporarily holding contact piece of the lever-fit-type connector shown in FIG. 14(*a*), and FIG. 14(*c*) is a section view taken along the C-C line shown in FIG. 14(*b*).
Figure 14B:
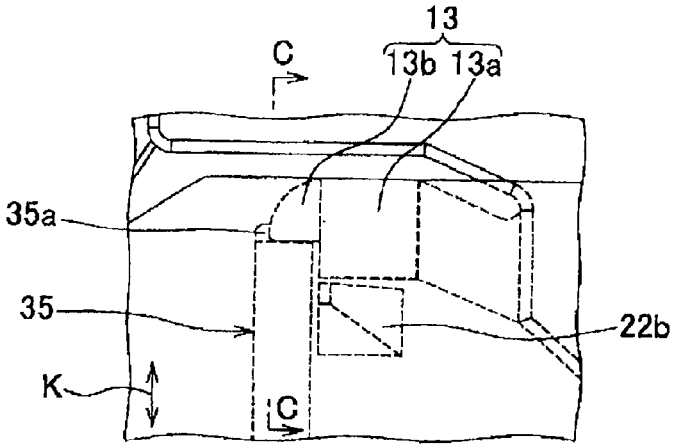
Figure 14C:
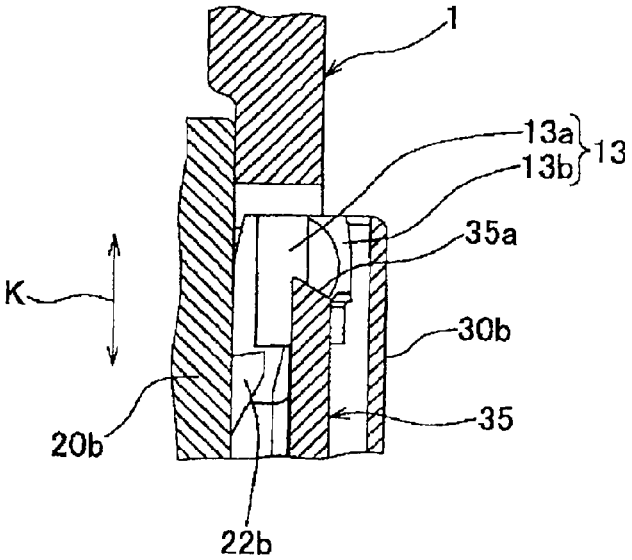

Next, the operation portion 14 of the lever of the lever-fit-type connector 10, as shown in FIG. 14(*a*), is pushed toward the second connector 3, as shown in FIGS. 14(*b*) and 14(*c*), the taper portion 35*a* advances further inside the flexible piece 13*b*, whereby the flexible piece 13*b* is flexed outwardly.

<Step 4>

Figure 15A:
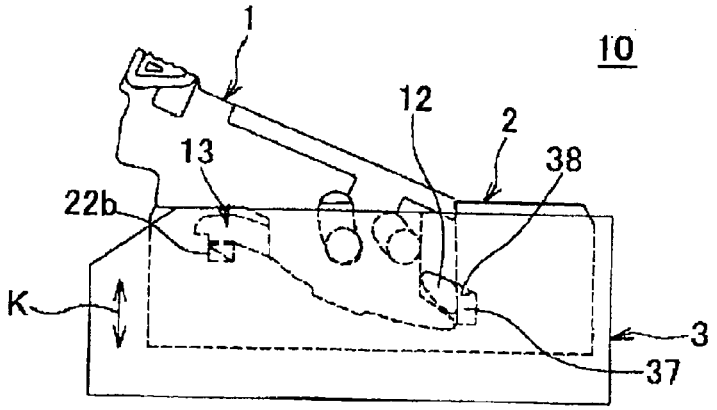
FIG. 15(*a*) is a plan view of the lever-fit-type connector shown in FIGS. 14(*a*), 14(*b*) and 14(*c*), showing a state where the rotation prevented state of the lever is released, FIG. 15(*b*) is an enlarged view of the temporarily holding contact piece of the lever-fit-type connector shown in FIG. 15(*a*), and FIG. 15(*c*) is a section view taken along the D-D line shown in FIG. 15(*b*).
Figure 15B:
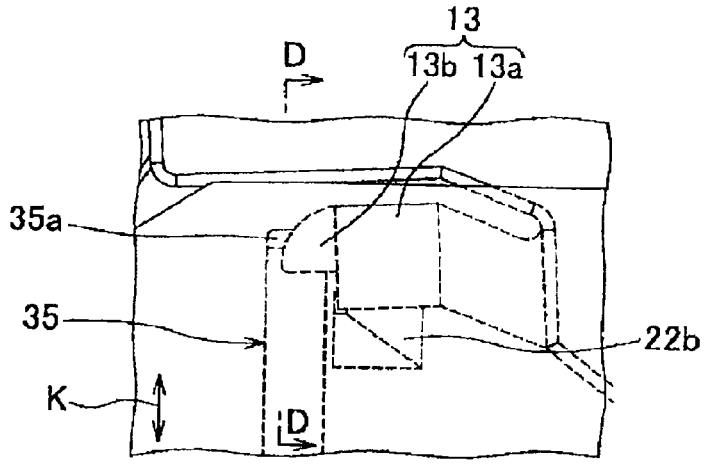
Figure 15C:
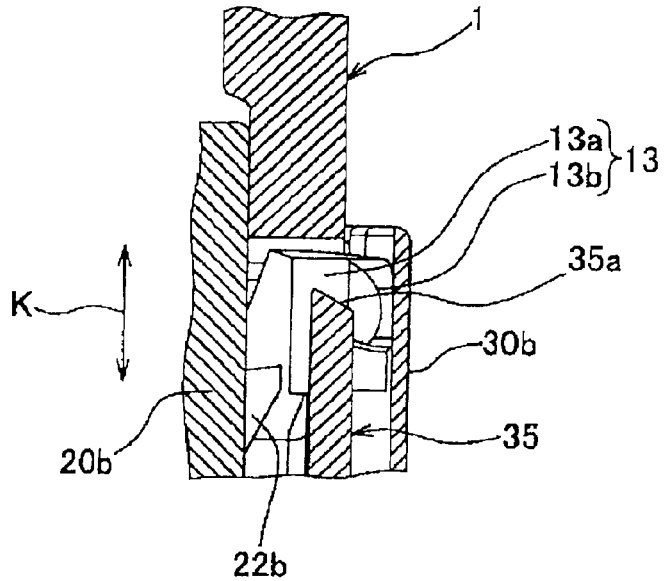

When the operation portion 14 is further pushed on, as shown in FIGS. 15(*a*) and 15(*b*), the contact projection portion 13*a* climbs up onto the temporarily holding projection portion 22*b* and, as shown in FIG. 15(*c*), the flexible piece 13*b* climbs over the taper portion 35*a* completely.

Thus, the rotation prevented state of the lever 1 is released. In this state, such outer edge 12*a* of the fulcrum projection 12 as exists nearest to the one end side of the lever 1 is situated below the second taper wall 38*a* in the fitting direction K. That is, the fulcrum projection 12 is positioned within the fulcrum projection storing groove 37.

Figure 19A:
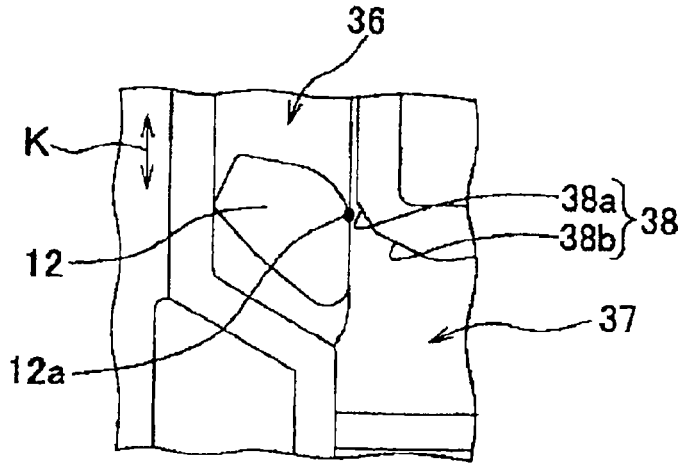
FIG. 19(*a*) is an enlarged view of the fulcrum projection of the lever-fit-type connector shown in FIGS. 14(*a*), 14(*b*) and 14(*c*), FIG. 19(*b*) is a section view of the lever-fit-type connector shown in FIG. 19(*a*), showing the position relation of the terminals thereof, and FIG. 19(*c*) is an explanatory view of the position of the fulcrum projection when the rotation prevented state of the lever of the lever-fit-type connector shown in FIG. 19(*a*) is released.
Figure 19B:
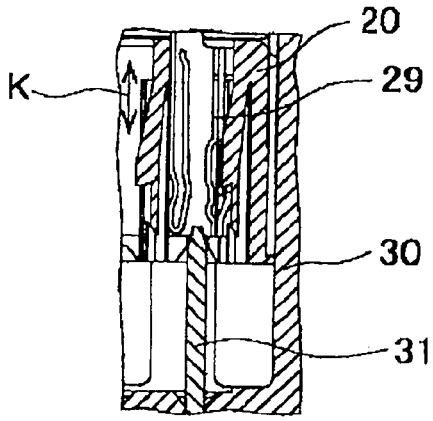
Figure 19C:
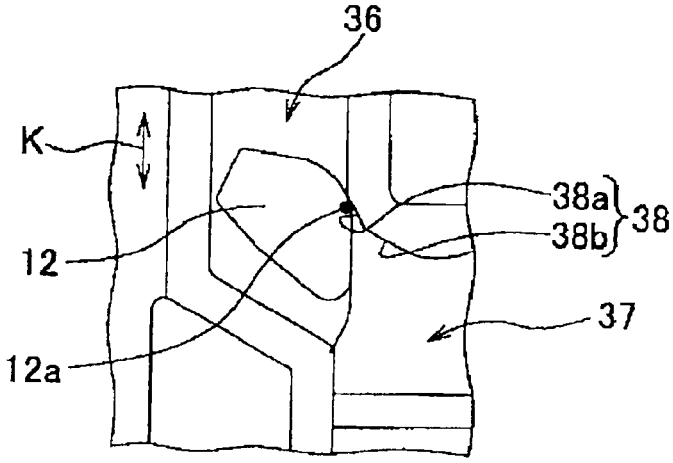

Also, as shown in FIG. 19(*b*), the terminals 29, 31 are not connected to each other. In this state, when the lever 1 is rotated, as shown in FIG. 19(*c*), the fulcrum projection 12 is picked up by the second taper wall 38*a* and is pulled into the fulcrum projection storing groove 37. And, the outer edge portion 12*a* is contacted with the second taper wall 38*a* and thus the fulcrum projection 12 is used to serve as a fulcrum.

<Step 5>

Figure 16A:
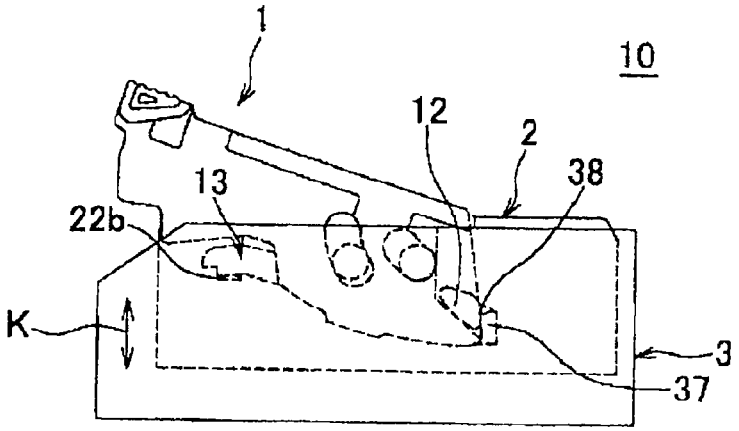
FIG. 16(*a*) is a plan view of the lever-fit-type connector shown in FIGS. 15(*a*), 15(*b*) and 15(*c*), showing a state where the connectors are temporarily set, FIG. 16(*b*) is an enlarged view of the temporarily holding contact piece of the lever-fit-type connector shown in FIG. 16(*a*), and FIG. 16(*c*) is a section view taken along the E-E line shown in FIG. 16(*b*).
Figure 16B:
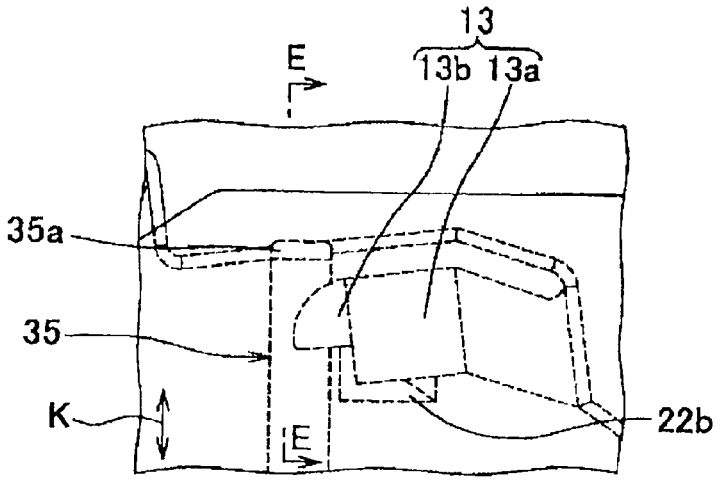
Figure 16C:
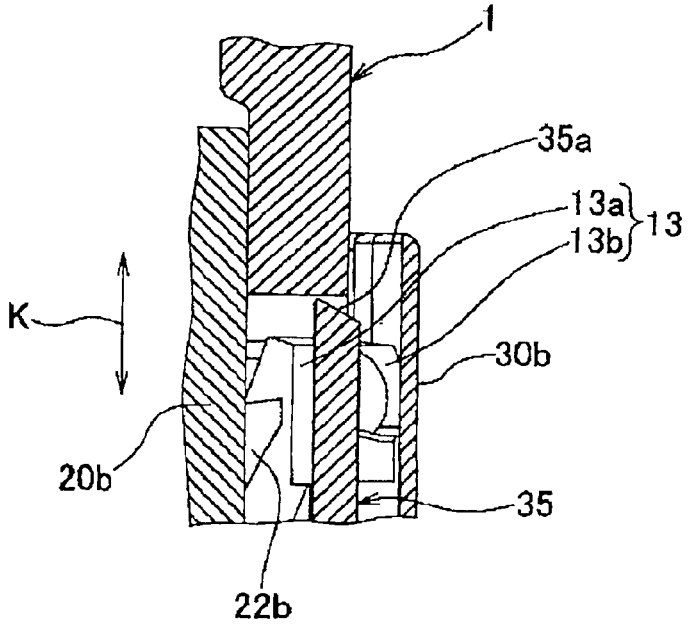
Figure 17A:
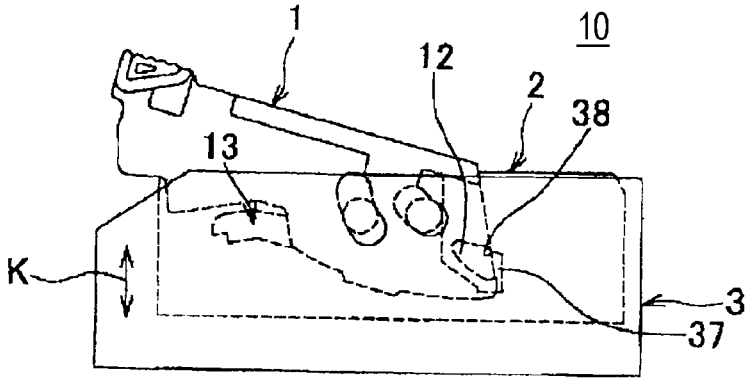
FIG. 17(*a*) plan view of the lever-fit-type connector shown in FIGS. 16(*a*), 16(*b*) and 16(*c*), showing a state where the lever starts to rotate, FIG. 17(*b*) is an enlarged view of the temporarily holding contact piece of the lever-fit-type connector shown in FIG. 17(*a*), and FIG. 17(*c*) is a section view taken along the F-F line shown in FIG. 17(*b*).
Figure 17B:
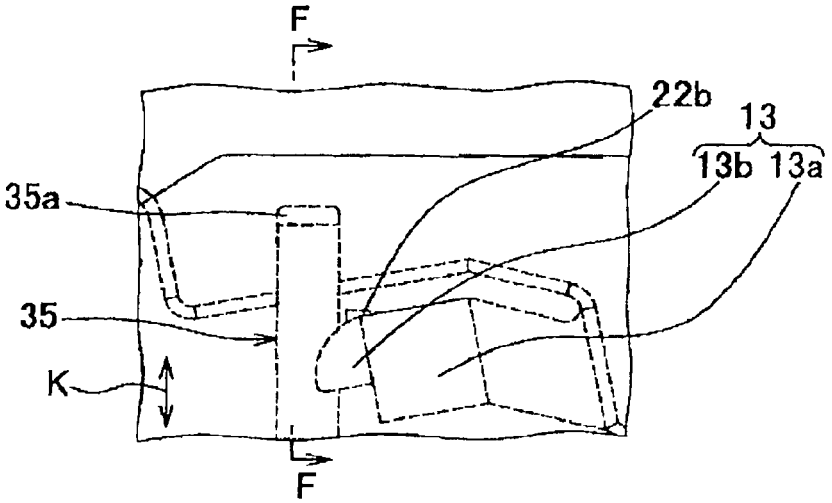
Figure 17C:
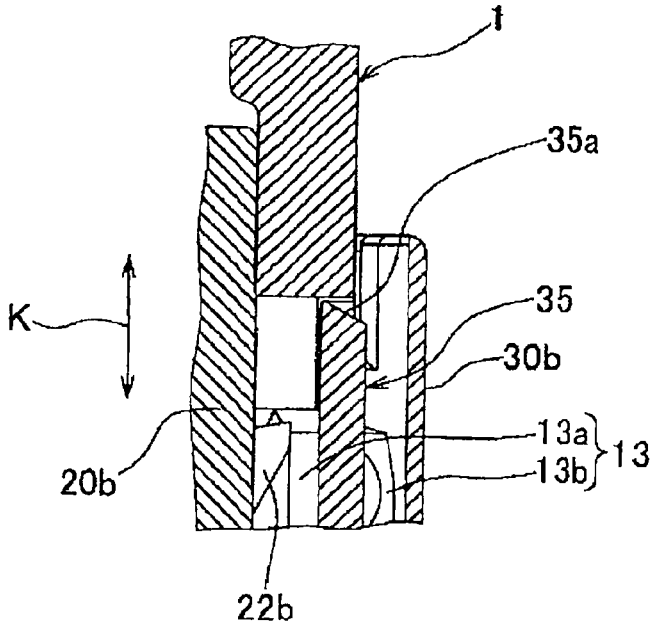
Figure 20A:
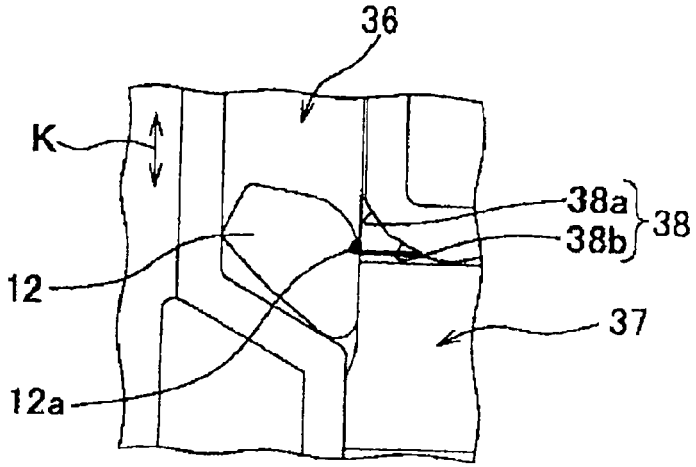
FIG. 20(*a*) is an enlarged view of the fulcrum projection of the lever-fit-type connector shown in FIGS. 16(*a*), 16(*b*) and 16(*c*), FIG. 20(*b*) is a section view of the lever-fit-type connector shown in FIG. 20(*a*), showing the position relation of the terminals thereof, and FIG. 20(*c*) is an explanatory view of the position of the fulcrum projection when the lever of the lever-fit-type connector shown in FIG. 20(*a*) is rotated.
Figure 20B:
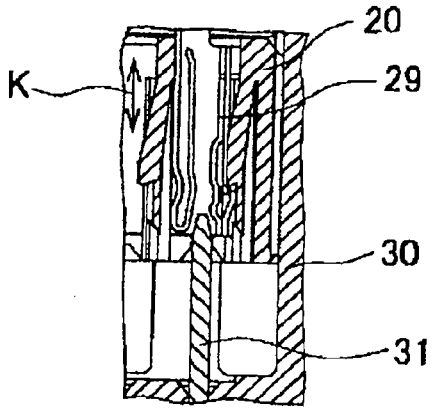
Figure 20C:
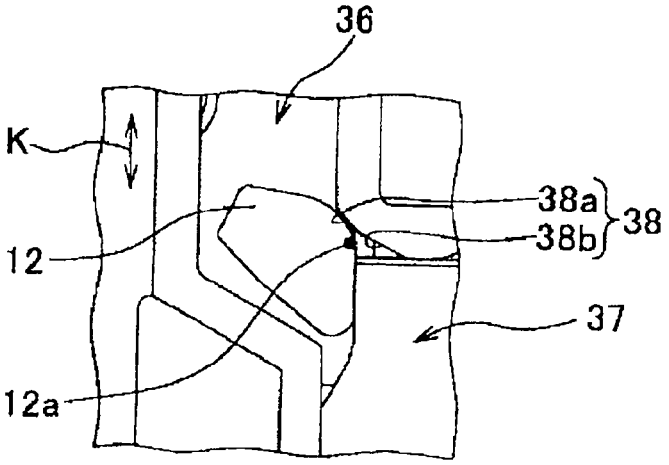

And, as shown in FIGS. 16(*a*) and 20(*a*), such outer edge 12*a* of the fulcrum projection 12 as exists nearest to the one end side of the lever 1 is situated below the first taper wall 38*b* along the fitting direction K. That is, the fulcrum projection 12 is positioned within the fulcrum projection storing groove 37. This position is expressed as a state where the connectors 2, 3 are temporarily set. This is a state where, as shown in FIG. 20(*b*), the terminals 29, 31 are not connected to each other. In this state, when the lever 1 is rotated, as shown in FIG. 20(*c*), the outer edge portion 12*a* of the fulcrum projection 12 is contacted with the first taper wall 38*b* and thus the fulcrum projection 12 is used to serve as a fulcrum.

<Step 6>

Figure 21A:
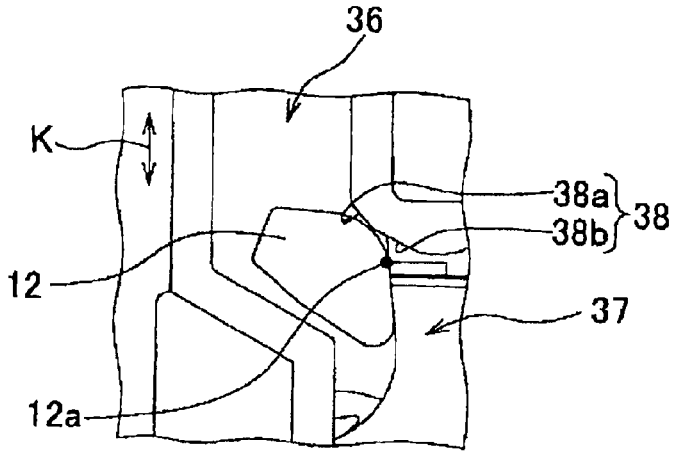
FIG. 21(*a*) is an enlarged view of the fulcrum projection of the lever-fit-type connector shown in FIGS. 17(*a*), 17(*b*) and 17(*c*), and FIG. 21(*b*) is a section view of the lever-fit-type connector shown in FIG. 21(*a*), showing the position relation of the terminals thereof.
Figure 21B:
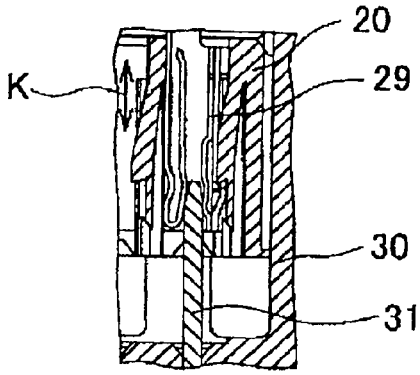
Figure 22A:
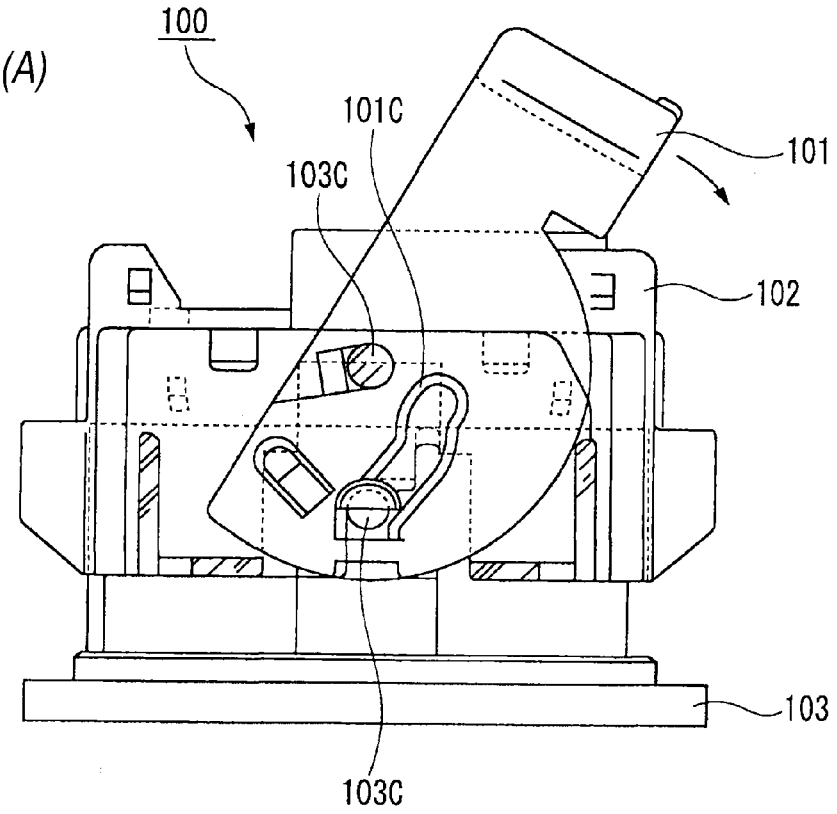
Figure 22B:
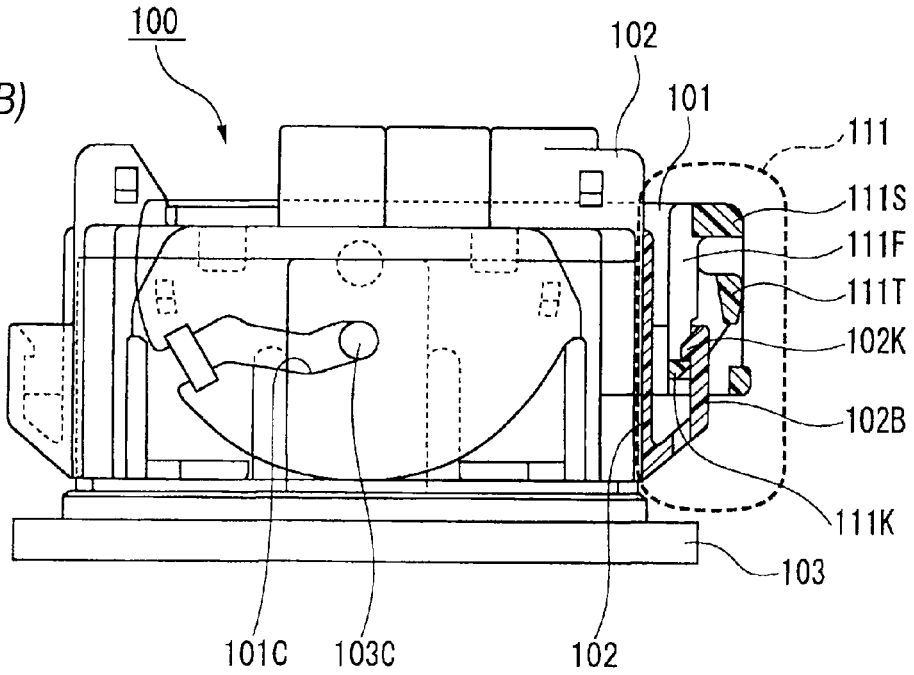
Figure 23A:
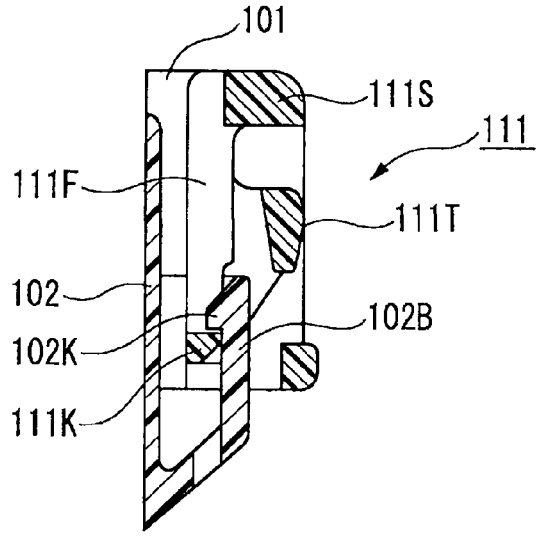
FIG. 23(A) is a section view of a lever lock portion, showing a state when the rotation of a lever 101 is completed.
Figure 23B:
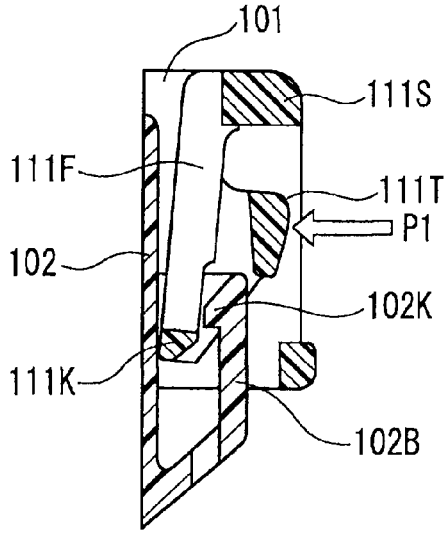
FIG. 23(B) is a section view thereof showing a state just after the engagement releasing operation is started.
Figure 23C:
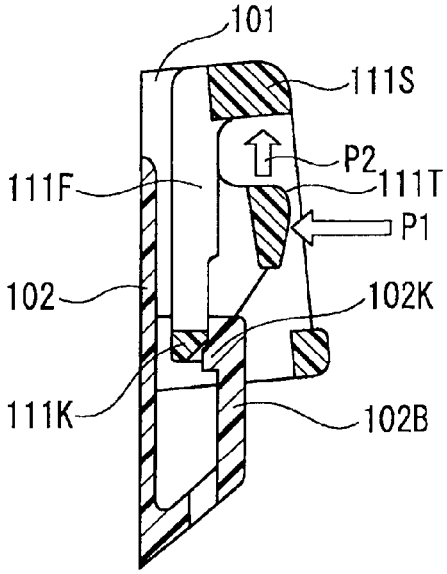
FIG. 23(C) is a section view thereof showing a state while the lever 101 is being pushed up.

When the lever 1 is started to rotate in this manner, as shown in FIG. 21(*a*), the boss portion storing holes 11*a*, 11*b* provide points of action of the lever 1 to push the boss portions 21*a*, 21*b* into the deep side of the fit space 39 along the fitting direction. Thus, as shown in FIG. 21(*b*), the terminal 31 is fitted into the terminal 29, whereby the terminals 29, 31 are electrically connected to each other.

In the above-mentioned lever-fit-type connector, in the rotation operation of the lever 1 after release of the rotation prevented state, in the process where the lever 1 is rotated along the fitting direction with the fulcrum projection 12 positioned within the fulcrum projection storing groove 36, the first connector 2 can be connected substantially parallel to the second connector 3.

Thus, according to this lever-fit-type connector, the terminals 29, 31 can be smoothly fitted with each other without receiving any unreasonable stress, thereby being able to maintain a close contact state between them with no shaking motion relative to each other. Therefore, the electrically connected state of the terminals 29, 31 can also be stabilized.

<Structure of Lever Lock Portion 120 of the Invention>

Next, description will be given below of the lever lock portion 120 of the invention provided in the above lever-fit-type connector.

FIG. 1 is a perspective view of a lever including the lever lock portion 120 of the invention.

In FIG. 1, the lever 1 includes, on the operation portion 14 side thereof, a lever lock portion 120 for holding the lever in the rotation prevented state when the rotation of the lever is completed. The lever lock portion 120 includes, on the lever 1 side thereof, a U-shaped long elastic piece 121F, a releasing projection 121T provided near the distal end of the U-shaped long elastic piece 121F and projected outwardly therefrom, and an engaging portion 121K formed between the releasing projection 121T and the U-shaped portion of the lower end of the U-shaped long elastic piece 121F.

The lever lock portion 120 also includes the following structure (to be discussed later) on the second connector 3 side as well. That is, the structure includes a lock receiving piece 123B formed to extend upwardly from the lower end portion 123U of the second connector 3 (FIG. 6(C)), and a lock receiving projection 123K engageable with the engaging portion 121K, while the lock receiving projection 123K is formed at the position of the lock receiving piece 123B where the engaging portion 121K of the U-shaped long elastic piece 121F is situated when the rotation of the lever 1 is completed.

After release of the engagement of the lever lock portion 120, by lifting up the operation portion 14 of the lever 1 in the solid-white arrow direction shown FIG. 6(A), the fit between the connectors can be released (to be discussed later).

<Section View of Lever Lock Portion 120>

Figure 2A:
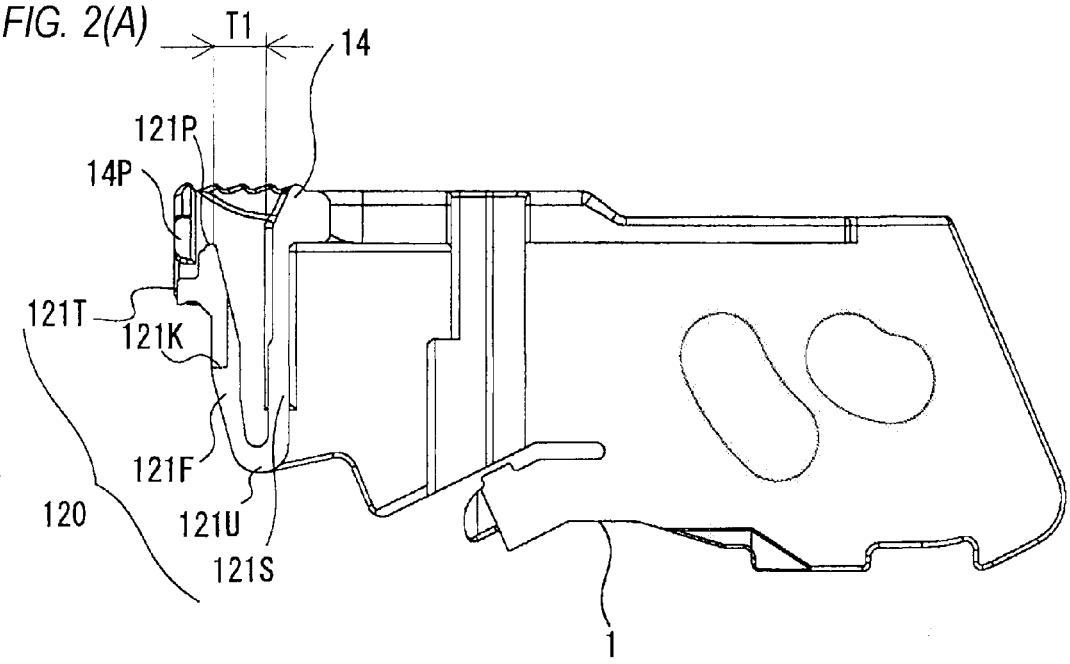
FIG. 2(A) is a longitudinal section view of a lever-fit-type connector shown in FIG. 1, showing a state when it is cut in the longitudinal direction.

FIG. 2(A) is a longitudinal section view of the lever-fit-type connector of FIG. 1, when it is cut vertically along the longitudinal direction.

In FIG. 2(A), the U-shaped long elastic piece 121F extends downwardly from the operation portion 14 side fixed end 121S of the lever 1 and makes a U-turn outwardly to return upwardly again. Near the distal end 121P of the U-shaped long elastic piece 121F, there is provided the releasing projection 121T having an outwardly facing projection shape. The engaging portion 121K is interposed between the releasing projection 121T and the U-shaped portion 121U of the lower end of the U-shaped long elastic piece 121F. The distal end 121P of the U-shaped long elastic piece 121F is prevented against forward movement by an upper end edge portion 14P.

A horizontal-direction clearance T1 existing between the fixed end 121S and the distal end 121P of the U-shaped long elastic piece 121F is formed to have a size allowing insertion of at least a human forefinger. The clearance T1 is exposed upwardly from the lever 1.

<Two Methods for Releasing Lever Lock Portion 120 of the Invention>

Figure 2B:
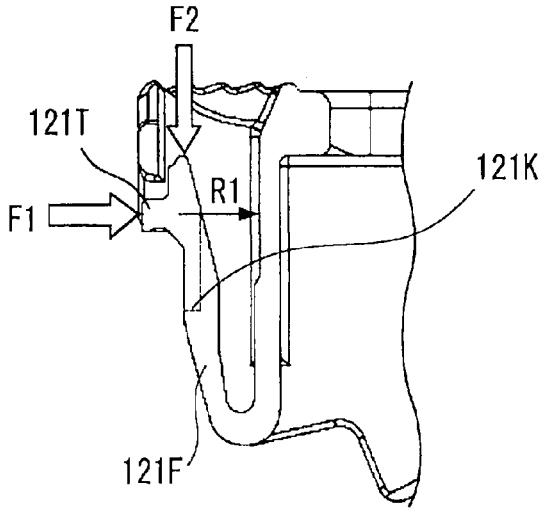
FIG. 2(B) is a partially enlarged view of the lever lock shown in FIG. 2(A), showing the releasing direction of the lever lock.
Figure 3A:
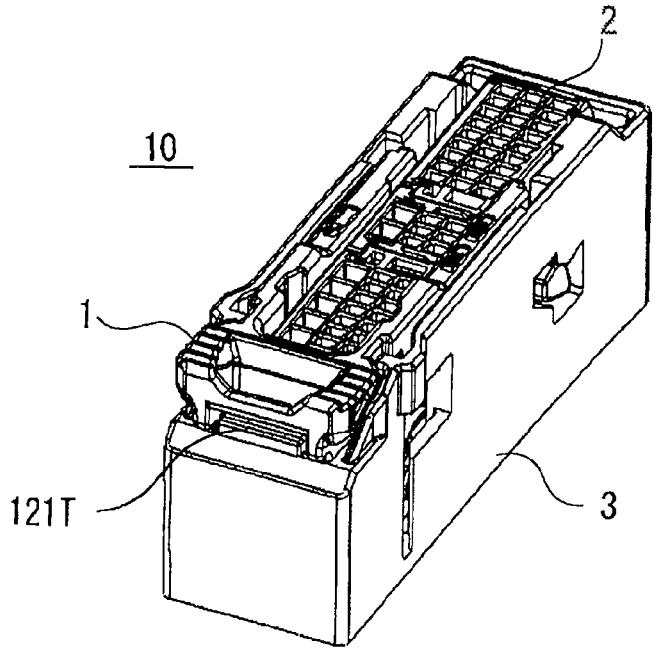
FIG. 3(A) is a perspective view of a first connector with a lever shown in FIG. 1, showing a state where it is fitted with a second connector.

The lever lock portion 120 of the invention is characterized in that two releasing methods can be realized. FIG. 2(B) is a partially enlarged view of the lever lock portion 120, explaining the two methods for releasing the lever lock portion 120 shown in FIG. 2(A). FIG. 3(A) is a perspective view of the lever-fit-type connector 10, showing a state the first connector 2 with the lever 1 is fitted with the second connector 3, and FIG. 3(B) is an enlarged perspective view of the lever operation portion shown in FIG. 3(A).

<First Releasing Method>

Figure 3B:
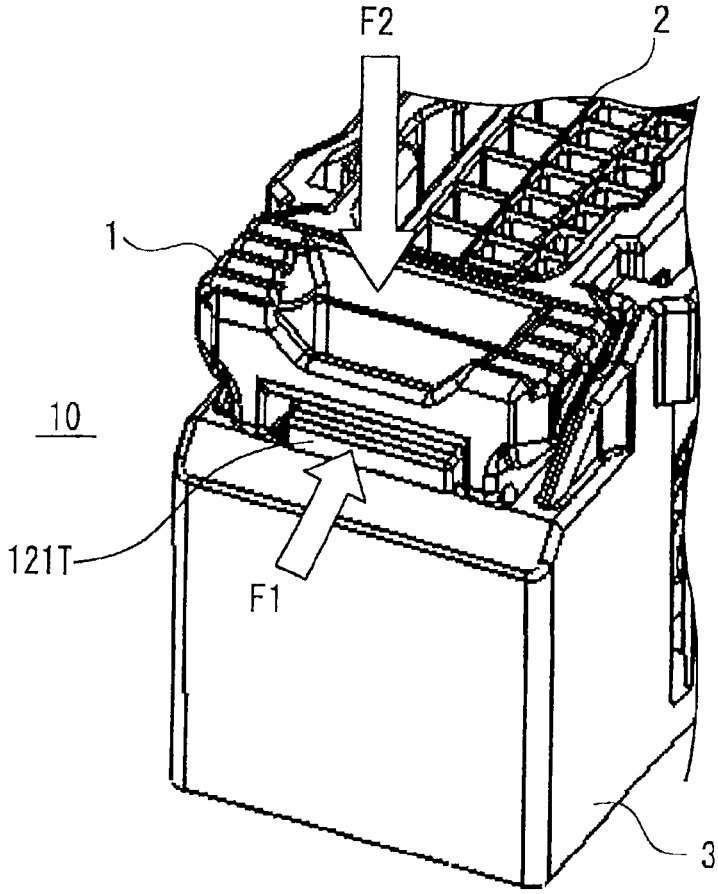
FIG. 3(B) is an enlarged perspective view of the operation portion of the lever shown in FIG. 3(A).

The first releasing method is an F1-direction access method shown in FIG. 2(B) and FIG. 3(B).

Figure 4A:
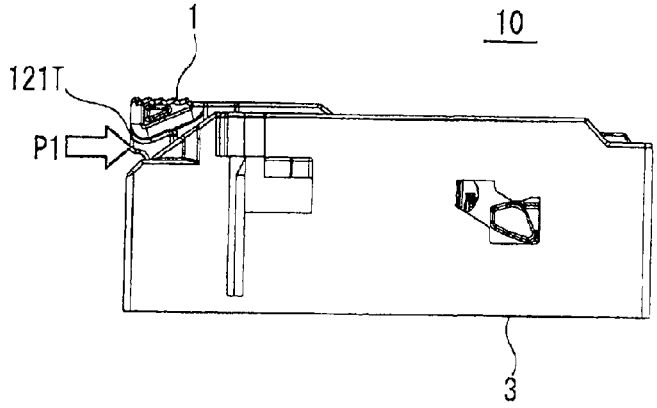
FIGS. 4(A), 4(B) and 4(C) show front views of the lever-fit-type connector, explaining the first releasing method (F1 direction access method) for releasing the connector in FIG. 3(B).
Figure 4B:
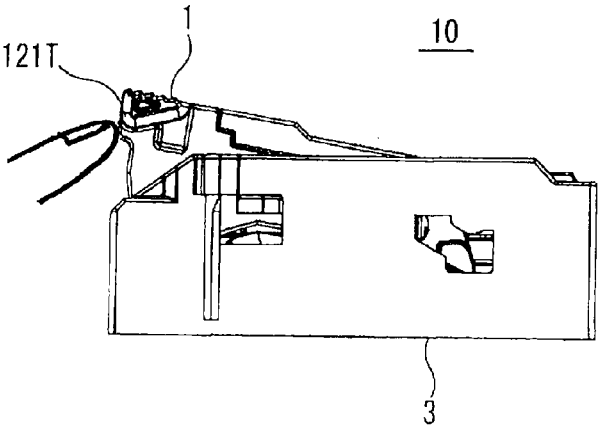
Figure 4C:
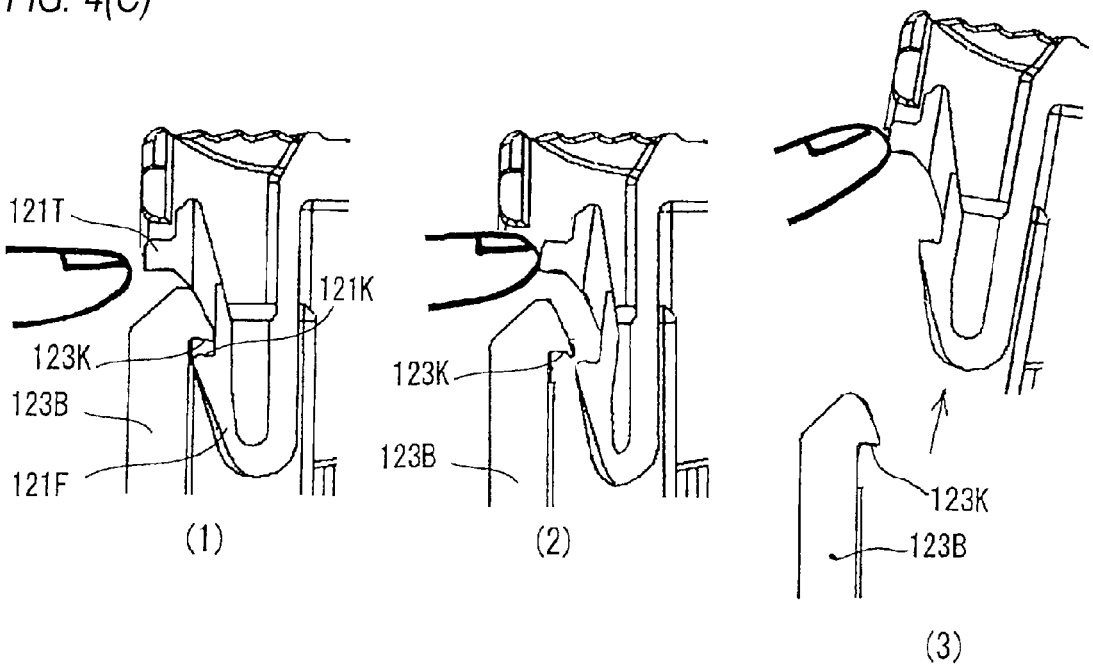

FIGS. 4(A), 4(B) and 4(C) show the front views of the lever-fit-type connector 10 to explain the first releasing method. Specifically, FIG. 4(A) is the front view to show a lever pushing direction in the lock releasing operation, FIG. 4(B) is the front view to show a lever pushing-up operation, and FIG. 4(C) is an enlarged section view of the lever lock portion, showing the procedure of the first releasing method shown in FIG. 4(A), in which (1) shows a state just before start of the releasing operation, (2) shows a state just after start of the releasing operation, and (3) shows a lever pushing-up state.

In FIGS. 2(B), 3(B) and 4(A), when the releasing projection 121T is pushed from outside in the solid-white arrow F1 direction using a forefinger, due to the flexing operation of the U-shaped long elastic piece 121F, the engaging portion 121K is shifted in the R1 direction and is disengaged from the lock receiving projection 123K of the second connector 3 (FIG. 4(C)), resulting in the state shown in (2) of FIG. 4(C).

Further, when the releasing projection 121T is pushed up upwardly as shown in (3) of FIG. 4(C) while being pushed by the forefinger, the lever 1 is rotated in the solid-white arrow direction shown in FIG. 1 and the first connector is thereby also rotated, whereby the fit between the first connector 2 and second connector 3 can be released with high operation efficiency. Here, of course, the direction of the forefinger shown in FIGS. 4(B) and (C) may also be reversed by 180 degrees.

<Two Advantages of First Releasing Method>

<1 of Two>

As described above, according to the first releasing method, the U-shaped long elastic piece 121F extends downwardly from the fixed end of the end portion of the lever and further makes a U-turn outwardly to return upwardly again and includes the releasing projection (point of force) near the distal end thereof, while the engaging portion (point of action) is formed between the fixed end (fulcrum) and releasing projection (point of force) of the end portion of the lever. This eliminates the need to use large pushing force when releasing the engagement.

<2 of Two>

Further, according to the first releasing method, since the operation to push the releasing projection 121T ((1) of FIG. 4(C)), the operation to release the engagement of the lever lock ((2) of FIG. 4(C)) and the operation to lift up the lever 1 ((3) of FIG. 4(C)) can be executed using only the forefinger, the lever operation efficiency can be enhanced.

<Second Releasing Method>

The second releasing method is an F2-direction access method shown in FIGS. 2(B) and 3(B).

Figure 5A:
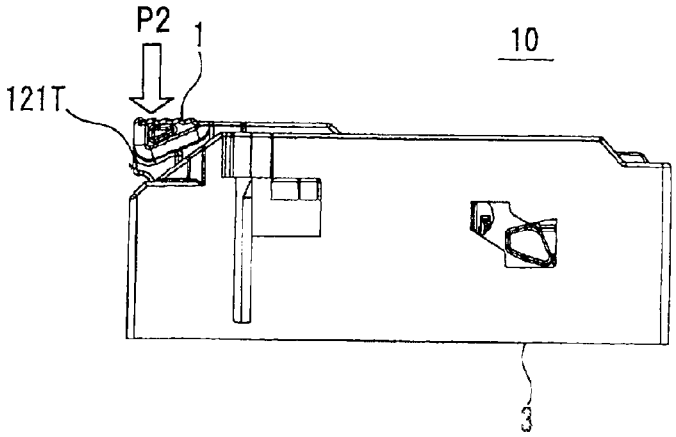
FIGS. 5(A), 5(B) and 5(C) show front views of the lever-fit-type connector, explaining the second releasing method (F2 direction access method) for releasing the connector in FIG. 3(B).
Figure 5B:
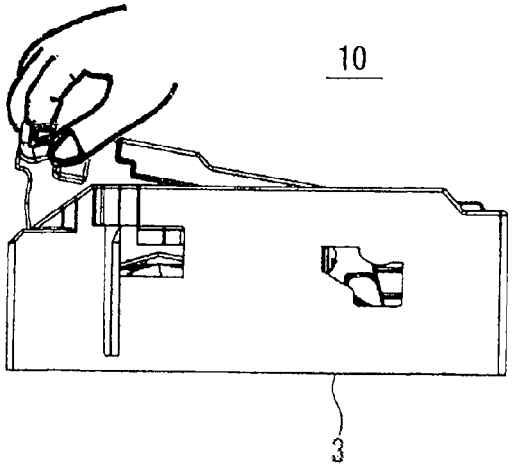
Figure 5C:
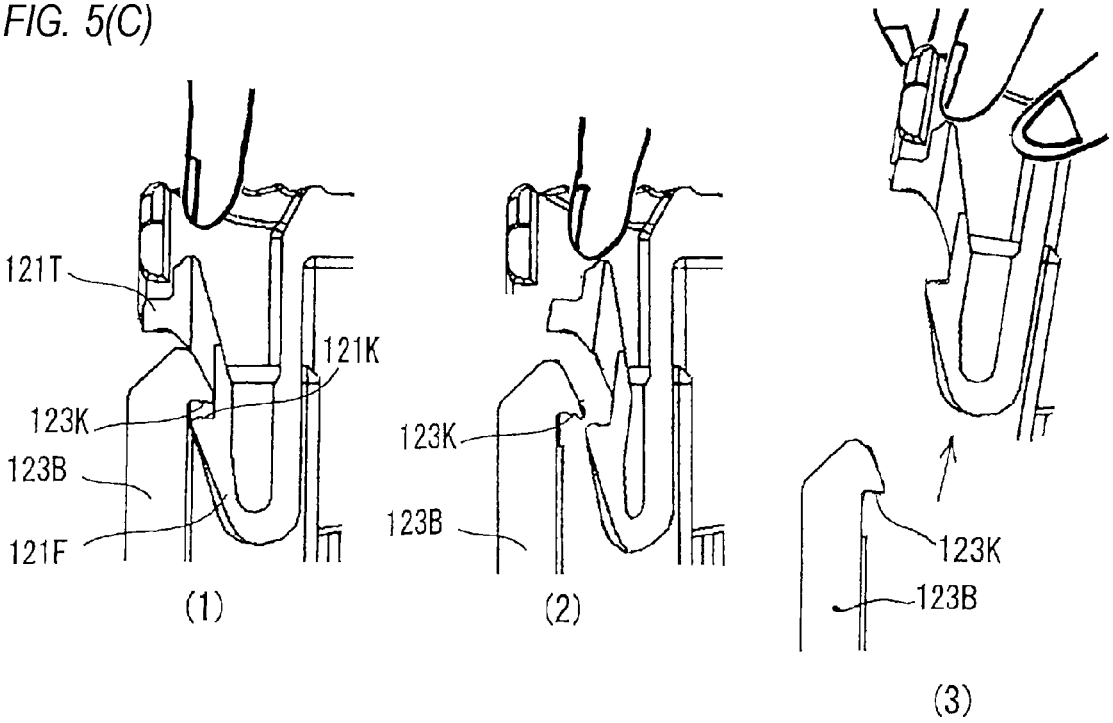

FIGS. 5(A), 5(B) and 5(C) show the front views of the lever-fit-type connector 10 to explain the second releasing method. Specifically, FIG. 5(A) is the front view to show a lever pushing direction in the lock releasing operation, FIG. 5(B) is the front view to show a lever pulling-up operation, and FIG. 5(C) is an enlarged section view of the lever lock portion, showing the procedure of the second releasing method shown in FIG. 5(A), in which (1) shows a state just before start of the releasing operation, (2) shows a state just after start of the releasing operation, and (3) shows a lever pulling-up state.

In FIGS. 2(B), 3(B) and 5(A), in the second releasing method, the releasing projection 121T is not pushed in the F1 direction but the forefinger is moved from outside upwardly in the solid-white arrow F2 (FIG. 5(A)) direction to the distal end 121P of the U-shaped long elastic piece 121F as shown in (1) of FIG. 5(C) to thereby push it. Thus, the distal end 121P is moved downward due to the flexing operation of the U-shaped long elastic piece 121F to release the engagement between the engaging portion 121K and the lock receiving projection 123K of the second connector 3. Further, when the distal end 121P is moved in the R1 (FIG. 2(B)) direction, that is, toward the fixed end 121S of the operation portion of the lever 1 while being pressed on by the forefinger, there is obtained a state shown in (2) of FIG. 5(C).

In this state, when, while the two side plates 14*a*, 14*b* (FIG. 1) of the operation portion 14 of the lever 1 are left sandwiched by a thumb and a middle finger, the operation portion 14 is lifted upwardly as shown in (3) of FIG. 5(C), the lever 1 can be rotated in the solid-white arrow direction shown in FIG. 1 and thus the first connector 2 can also be rotated, whereby the fit between the first connector 2 and second connector 3 can be released.

<Two Advantages of Second Releasing Method>

<1 of Two>

As described above, according to the second releasing method, the U-shaped long elastic piece 121F extends downwardly from the fixed end of the end portion of the lever and further makes a U-turn outwardly to return upwardly again and includes the releasing projection (point of force) near the distal end thereof, while the engaging portion (point of action) is formed between the fixed end (fulcrum) and releasing projection (point of force) of the end portion of the lever. This eliminates the need to use large pushing force when releasing the engagement.

<2 of Two>

Further, according to the second releasing method, since the thumb and the middle finger are further used to lift up the lever 1, although the operation efficiency thereof is slightly lower than that of the first releasing method, even when there is no space for pressing the releasing projection horizontally, the fingers can be inserted from above and thus the fit between the connectors can be conveniently released. In the lever-fit-type connector of PTL 1, the fit cannot be released by inserting the fingers from above.

<Fit and Removal Between First and Second Connectors>

Figure 6A:
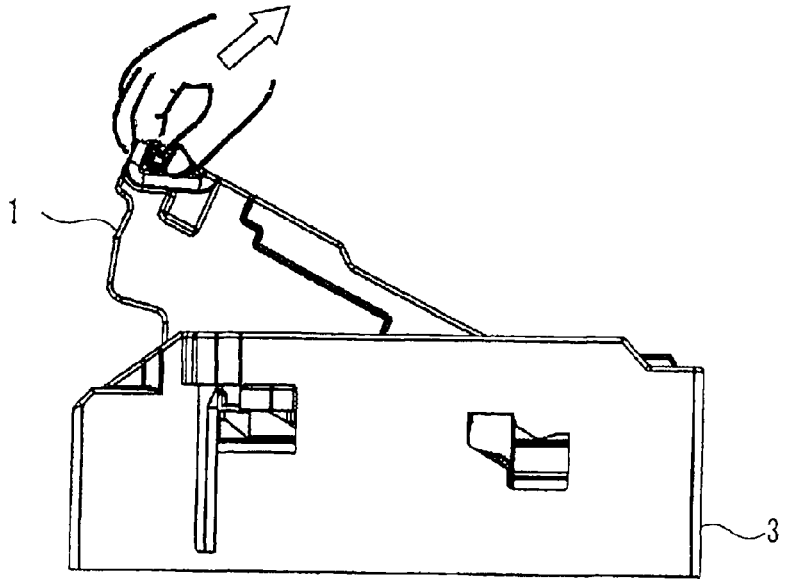
FIG. 6(A) is a front view of the lever-fit-type connector, explaining the lever releasing operation.
Figure 6B:
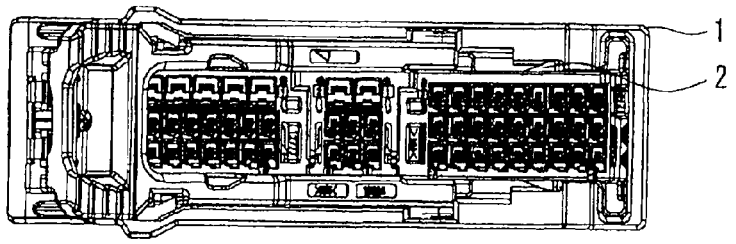
FIG. 6(B) is a plan view thereof.
Figure 6C:
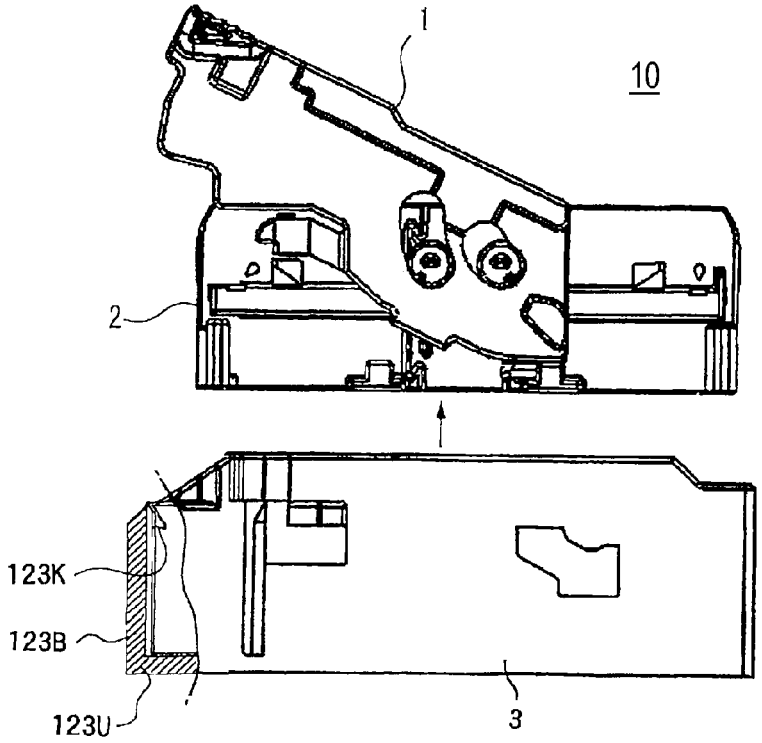
FIG. 6(C) is a front view thereof after release of fit between a first connector with a lever and a second connector, in which the second connector is partially broken.

FIG. 6(A) is a front view of the lever-fit-type connector, when releasing the lever, FIG. 6(A) is a plan thereof, and FIG. 6(C) is a front view after release of fit between the first and second connectors. The second connector 3 shown in FIG. 6(C) includes a lock receiving piece 123B extending upwardly from the lower end portion 123U, and a lock receiving projection 123K provided on the top portion of the lock receiving piece 123B. The lock receiving projection 123K, when the lever 1 rotates, is caused to face the engaging portion 121K of the U-shaped long elastic piece 121F and, due to the flexing operation of the U-shaped long elastic piece 121F, the engaging portion 121K climbs over the lock receiving projection 123K, whereby they are engaged with each other.

The engagement can be released using any one of the above two releasing methods.

After the engagement of the lever lock portion 120 is released, the further lift-up of the lever 1 is carried out according to a normal manner, that is, the lever 1 is lifted up while the two side plates 16*a*, 16*b* of the lever 1 are being sandwiched by the thumb and the middle finger in FIG. 6(A).

Due to use of the lever 1, the fit and removal between the first connector 2 and second connector 3 can be carried out using light lifting-up force as shown in FIG. 6(C).

<Embodiment 2>

In the embodiment 1, the lock receiving piece and lock receiving projection are provided on the second connector' side. However, also when they are provided on the first connector' side, the lever lock portion can be realized similarly.

<Summary>

As described above, the lever lock portion is the U-shaped long elastic piece which extends downwardly from the fixed end of the end portion of the lever and makes a U-turn to return upwardly, and the releasing projection is provided near the distal end of the lever lock portion. Therefore, the engagement of the engaging portion can be released without using large pushing force.

Also, when multiple lever-fit-type connectors are arranged adjacently, a forefinger is inserted from above into a clearance formed between the fixed end side and distal end side of the U-shaped long elastic piece in the horizontal direction, the distal end of the U-shaped long elastic piece is moved toward the fixed end by the forefinger while depressing the distal end to thereby release the engagement between the engaging portion and lock receiving projection, and, in this state, the two side surfaces of the operation portion of the lever are sandwiched and lifted upwardly by a thumb and a forefinger, thereby being able to release the lever lock.

Therefore, instead of pushing the releasing projection horizontally, by inserting the finger from above, the lever lock can be released although the operation is slightly troublesome.

The present application is based on Japanese Patent Application No. 2011-239432 filed on Oct. 31, 2012, the contents of which are incorporated herein by way of reference.

REFERENCE SIGNS LIST

1: Lever
2: First connector
3: Second connector
10: Lever-fit-type connector
12: Fulcrum projection

13: Temporarily holding contact piece
14: Operation portion
14P: Upper end edge portion
20*a*, 20*b*: Side surface
21*a*, 21*b*: Boss portion
22*a*, 22*b*: Temporarily holding projection portion
35: Releasing plate portion
35*a*: Taper portion
36: Fulcrum projection guide groove
37: Fulcrum projection storing groove
39: Fit space
K: Fitting direction
120: Lever lock portion
121F: U-shaped long elastic piece
121K: Engaging portion
121P: Distal end
121S: Fixed end
121T: Releasing projection

The invention claimed is:

1. A lever-fit-type connector comprising:
a first connector;
a lever provided on the first connector; and
a second connector configured to be fitted with the first connector by an operation of the lever, wherein
the lever includes a U-shaped elastic member including:
a proximal end portion fixed to the lever;
a distal end portion projecting in a vertical direction;
a projecting portion projecting in a horizontal direction in the vicinity of the distal end portion;
a U-shaped portion disposed between the proximal end portion and the distal end portion; and
an engaging portion disposed between the distal end portion and the U-shaped portion,
the U-shaped elastic member has a clearance between the proximal end portion and the distal end portion in the horizontal direction, and
one of the first connector and the second connector includes an engaging portion operable to be engaged with the engaging portion of the U-shaped elastic member of the lever,
wherein a portion of the distal end portion extends vertically beyond the projecting portion, and a portion of the projecting portion extends horizontally beyond the portion of the distal end portion.

2. The lever-fit-type connector according to claim 1, wherein the clearance is exposed upwardly from the lever.

3. The lever-fit-type connector according to claim 1, wherein
the first connector includes a boss portion on a side surface,
the lever includes: a central portion rotatably mounted on the boss portion of the first connector; and a fulcrum projection provided on one end,
the second connector includes: a fit space; and a groove formed in an inner wall of the fit space,
in a state that the fulcrum projection of the lever is positioned in the groove of the second connector, by pushing the other end of the lever toward the second connector to rotate lever to cause the fulcrum projection of the lever to act as a fulcrum and to cause the central portion of the first connector to act as a point of action, the first connector is pushed into the fit space and is fitted with the second connector.

* * * * *